US006250734B1

(12) United States Patent
Otsuki

(10) Patent No.: US 6,250,734 B1
(45) **Date of Patent: *Jun. 26, 2001**

(54) METHOD AND APPARATUS FOR PRINTING WITH DIFFERENT SHEET FEEDING AMOUNTS AND ACCURACIES

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/228,969

(22) Filed: Jan. 12, 1999

(30) Foreign Application Priority Data

Jan. 23, 1998 (JP) ..... 10-026575

(51) Int. Cl.[7] ..... B41J 29/38; B41J 2/01
(52) U.S. Cl. ..... 347/16; 347/41
(58) Field of Search ..... 347/41, 12, 16, 347/9

(56) References Cited

U.S. PATENT DOCUMENTS

| | | | | |
|---|---|---|---|---|
| 4,198,642 | | 4/1980 | Gamblin . | |
| 5,625,391 | * | 4/1997 | Hirabayashi et al. | 347/41 |
| 5,677,716 | * | 10/1997 | Cleveland | 347/41 X |

FOREIGN PATENT DOCUMENTS

| | | |
|---|---|---|
| 0 622 211 | 11/1994 | (EP) . |
| 0 622 224 | 11/1994 | (EP) . |
| 0 679 518 | 11/1995 | (EP) . |
| 0 751 476 | 1/1997 | (EP) . |
| 0 812 694 | 12/1997 | (EP) . |
| 53-2040 | 1/1978 | (JP) . |

* cited by examiner

*Primary Examiner*—David F. Yockey
(74) *Attorney, Agent, or Firm*—Oblon, Spivak, McClelland, Maier & Neustadt, P.C.

(57) ABSTRACT

In an inkjet printer controlled by a program in a recording medium, the interlace method is applied to record an image in a first area where the rollers in the feeding section ensure the accuracy of sheet feeding, in order to attain the high picture quality. A printable area where an image can be recorded is extended to a second area, where rollers in a delivering section are used to carry out the sheet feeding of relatively low accuracy after the lower end of the printing medium comes off the rollers in the feeding section. The second area does not directly adjoin to the first area, but there is a middle area that adjoins to both the first area and the second area and enables image recording with sufficient accuracy of sheet feeding. The intermediate processing in the middle area with smaller amounts of sub-scan than the amounts of sub-scan in the first area effectively extends the high-quality image recording area that ensures recording of the image with the high quality equivalent to that in the first area.

8 Claims, 20 Drawing Sheets

Fig.12

| Passes | P1 | P2 | P3 | P4 | P5 | P6 | P7 | P8 | P9 | P10 | P11 |
|---|---|---|---|---|---|---|---|---|---|---|---|
| Feeding Amounts | 7 | 7 | 7 | 7 | 4 | 3 | 3 | 3 | 7 | 5 | 5 |
| Nozzle Nos. | Standard Printing | | | | Intermediate Processing | | | | Extension Printing | | |
| #1 | -52 | -45 | -38 | -31 | n/a | -24 | n/a | n/a | n/a | n/a | n/a |
| #2 | -48 | -41 | -34 | -27 | n/a | -20 | -17 | n/a | n/a | n/a | 3 |
| #3 | -44 | -37 | -30 | -23 | n/a | -16 | -13 | -10 | n/a | 2 | 7 |
| #4 | -40 | -33 | -26 | -19 | n/a | -12 | -9 | -6 | 1 | 6 | 11 |
| #5 | -36 | -29 | -22 | -15 | n/a | -8 | -5 | -2 | 5 | 10 | 15 |
| #6 | -32 | -25 | -18 | -11 | n/a | -4 | -1 | n/a | n/a | n/a | n/a |
| #7 | -28 | -21 | -14 | -7 | -3 | 0 | n/a | n/a | n/a | n/a | n/a |

Fig.13

| Feeding Amounts | 47 | 47 | 47 | 47 | 47 | 47 | 15 | 5 | 5 | 5 | 5 | 5 | 47 | 43 | 43 | 43 | 43 | 43 |
|---|---|---|---|---|---|---|---|---|---|---|---|---|---|---|---|---|---|---|
| Nozzle Nos. | P-11 | P-10 | P-9 | P-8 | P-7 | P-6 | P-5 | P-4 | P-3 | P-2 | P-1 | P0 | P1 | P2 | P3 | P4 | P5 | P6 |
| #1 | -531 | -484 | -437 | -390 | -343 | -296 | n/a | n/a | n/a | n/a | n/a | n/a | n/a | n/a | n/a | n/a | n/a | 6 |
| #2 | -525 | -478 | -431 | -384 | -337 | -290 | n/a | n/a | n/a | n/a | n/a | n/a | n/a | n/a | n/a | n/a | n/a | 12 |
| #3 | -519 | -472 | -425 | -378 | -331 | -284 | n/a | n/a | n/a | n/a | -249 | n/a | n/a | n/a | n/a | n/a | n/a | 18 |
| #4 | -513 | -466 | -419 | -372 | -325 | -278 | n/a | n/a | n/a | n/a | -243 | n/a | n/a | n/a | n/a | n/a | n/a | 24 |
| #5 | -507 | -460 | -413 | -366 | -319 | -272 | n/a | n/a | n/a | n/a | -237 | n/a | n/a | n/a | n/a | n/a | n/a | 30 |
| #6 | -501 | -454 | -407 | -360 | -313 | -266 | n/a | n/a | n/a | n/a | -231 | n/a | n/a | n/a | n/a | n/a | n/a | n/a |
| #7 | -495 | -448 | -401 | -354 | -307 | -260 | n/a | n/a | n/a | n/a | -225 | n/a | n/a | n/a | n/a | n/a | n/a | n/a |
| #8 | -489 | -442 | -395 | -348 | -301 | -254 | n/a | n/a | n/a | n/a | -219 | n/a | n/a | n/a | n/a | n/a | 5 | n/a |
| #9 | -483 | -436 | -389 | -342 | -295 | -248 | n/a | n/a | n/a | n/a | -213 | n/a | n/a | n/a | n/a | n/a | 11 | n/a |
| #10 | -477 | -430 | -383 | -336 | -289 | -242 | n/a | n/a | n/a | n/a | -207 | -202 | n/a | n/a | n/a | n/a | 17 | n/a |
| #11 | -471 | -424 | -377 | -330 | -283 | -236 | n/a | n/a | n/a | n/a | -201 | -196 | n/a | n/a | n/a | n/a | 23 | n/a |
| #12 | -465 | -418 | -371 | -324 | -277 | -230 | n/a | n/a | n/a | n/a | -195 | -190 | n/a | n/a | n/a | n/a | 29 | n/a |
| #13 | -459 | -412 | -365 | -318 | -271 | -224 | n/a | n/a | n/a | n/a | -189 | -184 | n/a | n/a | n/a | n/a | 35 | n/a |
| #14 | -453 | -406 | -359 | -312 | -265 | -218 | n/a | n/a | n/a | n/a | -183 | -178 | n/a | n/a | n/a | n/a | n/a | n/a |
| #15 | -447 | -400 | -353 | -306 | -259 | -212 | n/a | n/a | n/a | n/a | -177 | -172 | n/a | n/a | n/a | 4 | n/a | n/a |
| #16 | -441 | -394 | -347 | -300 | -253 | -206 | n/a | n/a | n/a | n/a | -171 | -166 | n/a | n/a | n/a | 10 | n/a | n/a |
| #17 | -435 | -388 | -341 | -294 | -247 | -200 | n/a | n/a | n/a | n/a | -165 | -160 | n/a | n/a | n/a | 16 | n/a | n/a |
| #18 | -429 | -382 | -335 | -288 | -241 | -194 | n/a | n/a | n/a | n/a | -159 | -154 | n/a | n/a | n/a | 22 | n/a | n/a |
| #19 | -423 | -376 | -329 | -282 | -235 | -188 | n/a | n/a | n/a | n/a | -153 | -148 | n/a | n/a | n/a | 28 | n/a | n/a |
| #20 | -417 | -370 | -323 | -276 | -229 | -182 | n/a | n/a | n/a | n/a | -147 | -142 | n/a | n/a | n/a | 34 | n/a | n/a |
| #21 | -411 | -364 | -317 | -270 | -223 | -176 | n/a | n/a | n/a | n/a | -141 | -136 | n/a | n/a | n/a | n/a | n/a | n/a |
| #22 | -405 | -358 | -311 | -264 | -217 | -170 | -155 | n/a | n/a | n/a | -135 | -130 | n/a | n/a | 3 | n/a | n/a | n/a |
| #23 | -399 | -352 | -305 | -258 | -211 | -164 | -149 | n/a | n/a | n/a | -129 | -124 | n/a | n/a | 9 | n/a | n/a | n/a |
| #24 | -393 | -346 | -299 | -252 | -205 | -158 | -143 | n/a | n/a | n/a | -123 | -118 | n/a | n/a | 15 | n/a | n/a | n/a |
| | ←Standard Printing→ | | | | | | ←Intermediate Processing→ | | | | | | ←Extension Printing→ | | | | | |

Fig.14

| Feeding Amounts | 47 | 47 | 47 | 47 | 47 | 47 | 15 | 5 | 5 | 5 | 5 | 5 | 47 | 43 | 43 | 43 | 43 | 43 |
|---|---|---|---|---|---|---|---|---|---|---|---|---|---|---|---|---|---|---|
| #25 | -387 | -340 | -293 | -246 | -199 | -152 | -137 | n/a | n/a | n/a | -117 | -112 | n/a | n/a | 21 | n/a | n/a | n/a |
| #26 | -381 | -334 | -287 | -240 | -193 | -146 | -131 | n/a | n/a | n/a | -111 | -106 | n/a | n/a | 27 | n/a | n/a | n/a |
| #27 | -375 | -328 | -281 | -234 | -187 | -140 | -125 | n/a | n/a | n/a | -105 | -100 | n/a | n/a | 33 | n/a | n/a | n/a |
| #28 | -369 | -322 | -275 | -228 | -181 | -134 | -119 | n/a | n/a | n/a | -99 | -94 | n/a | n/a | n/a | n/a | n/a | n/a |
| #29 | -363 | -316 | -269 | -222 | -175 | -128 | -113 | -108 | n/a | n/a | -93 | -88 | n/a | 2 | n/a | n/a | n/a | n/a |
| #30 | -357 | -310 | -263 | -216 | -169 | -122 | -107 | -102 | n/a | n/a | -87 | -82 | n/a | 8 | n/a | n/a | n/a | n/a |
| #31 | -351 | -304 | -257 | -210 | -163 | -116 | -101 | -96 | n/a | n/a | -81 | -76 | n/a | 14 | n/a | n/a | n/a | n/a |
| #32 | -345 | -298 | -251 | -204 | -157 | -110 | -95 | -90 | n/a | n/a | -75 | -70 | n/a | 20 | n/a | n/a | n/a | n/a |
| #33 | -339 | -292 | -245 | -198 | -151 | -104 | -89 | -84 | n/a | n/a | -69 | -64 | n/a | 26 | n/a | n/a | n/a | n/a |
| #34 | -333 | -286 | -239 | -192 | -145 | -98 | -83 | -78 | n/a | n/a | -63 | -58 | n/a | 32 | n/a | n/a | n/a | n/a |
| #35 | -327 | -280 | -233 | -186 | -139 | -92 | -77 | -72 | n/a | n/a | -57 | -52 | n/a | 38 | n/a | n/a | n/a | n/a |
| #36 | -321 | -274 | -227 | -180 | -133 | -86 | -71 | -66 | -61 | n/a | -51 | -46 | 1 | 44 | n/a | n/a | n/a | n/a |
| #37 | -315 | -268 | -221 | -174 | -127 | -80 | -65 | -60 | -55 | n/a | -45 | -40 | 7 | 50 | n/a | n/a | n/a | n/a |
| #38 | -309 | -262 | -215 | -168 | -121 | -74 | -59 | -54 | -49 | n/a | -39 | -34 | 13 | 56 | n/a | n/a | n/a | n/a |
| #39 | -303 | -256 | -209 | -162 | -115 | -68 | -53 | -48 | -43 | n/a | -33 | -28 | 19 | 62 | n/a | n/a | n/a | n/a |
| #40 | -297 | -250 | -203 | -156 | -109 | -62 | -47 | -42 | -37 | n/a | -27 | -22 | 25 | 68 | n/a | n/a | n/a | n/a |
| #41 | -291 | -244 | -197 | -150 | -103 | -56 | -41 | -36 | -31 | n/a | -21 | -16 | 31 | 74 | n/a | n/a | n/a | n/a |
| #42 | -285 | -238 | -191 | -144 | -97 | -50 | -35 | -30 | -25 | n/a | -15 | -10 | n/a | 80 | n/a | n/a | n/a | n/a |
| #43 | -279 | -232 | -185 | -138 | -91 | -44 | -29 | -24 | -19 | -14 | -9 | -4 | n/a | 86 | n/a | n/a | n/a | n/a |
| #44 | -273 | -226 | -179 | -132 | -85 | -38 | -23 | -18 | -13 | -8 | -3 | n/a | n/a | n/a | n/a | n/a | n/a | n/a |
| #45 | -267 | -220 | -173 | -126 | -79 | -32 | -17 | -12 | -7 | -2 | n/a | n/a | n/a | n/a | n/a | n/a | n/a | n/a |
| #46 | -261 | -214 | -167 | -120 | -73 | -26 | -11 | -6 | -1 | n/a | n/a | n/a | n/a | n/a | n/a | n/a | n/a | n/a |
| #47 | -255 | -208 | -161 | -114 | -67 | -20 | -5 | 0 | n/a | n/a | n/a | n/a | n/a | n/a | n/a | n/a | n/a | n/a |
| #48 | n/a | n/a | n/a | n/a | n/a | n/a | n/a | n/a | n/a | n/a | n/a | n/a | n/a | n/a | n/a | n/a | n/a | n/a |
| | ←Standard Printing→ | | | | | | ←Intermediate Processing→ | | | | | | ←Extension Printing→ | | | | | |

Fig.16

| Passes | P1 | P2 | P3 | P4 | P5 | P6 | P7 | P8 | P9 | P10 | P11 | P12 | P13 |
|---|---|---|---|---|---|---|---|---|---|---|---|---|---|
| Feeding Amounts | 7 | 7 | 7 | 7 | 3 | 1 | 1 | 1 | 1 | 7 | 7 | 7 | 7 |
| Nozzle Nos. | Standard Printing | | | | Intermediate Processing | | | | | Extension Printing | | | |
| #1 | -52 | -45 | -38 | -31 | n/a | n/a | n/a | n/a | n/a | n/a | n/a | n/a | 4 |
| #2 | -48 | -41 | -34 | -27 | -24 | n/a | n/a | n/a | n/a | n/a | n/a | 1 | 8 |
| #3 | -44 | -37 | -30 | -23 | -20 | n/a | n/a | -17 | n/a | n/a | n/a | 5 | 12 |
| #4 | -40 | -33 | -26 | -19 | -16 | n/a | n/a | -13 | n/a | n/a | 2 | 9 | 16 |
| #5 | -36 | -29 | -22 | -15 | -12 | n/a | -10 | -9 | n/a | n/a | 6 | 13 | 20 |
| #6 | -32 | -25 | -18 | -11 | -8 | n/a | -6 | -5 | n/a | 3 | 10 | 17 | 24 |
| #7 | -28 | -21 | -14 | -7 | -4 | -3 | -2 | -1 | 0 | 7 | 14 | 21 | 28 |

Fig.18

| Passes | P1 | P2 | P3 | P4 | P5 | P6 | P7 | P8 | P9 | P10 | P11 | P12 | P13 | P14 | P15 | P16 | P17 | P18 | P19 | P20 | P21 | P22 |
|---|---|---|---|---|---|---|---|---|---|---|---|---|---|---|---|---|---|---|---|---|---|---|
| Feeding Amounts | 3 | 3 | 3 | 3 | 3 | 3 | 3 | 3 | 2 | 1 | 1 | 1 | 1 | 1 | 1 | 1 | 2 | 3 | 3 | 3 | 3 | 3 |
| Pass Nos. | -15 | -14 | -13 | -12 | -11 | -10 | -9 | -8 | -7 | -6 | -5 | -4 | -3 | -2 | -1 | 0 | 1 | 2 | 3 | 4 | 5 | 6 |
| Nozzle Nos. | Standard Printing | | | | | | | | Intermediate Processing | | | | | | | | Extension Printing | | | | | |
| #1 | -46 | -43 | -40 | -37 | -34 | -31 | -28 | -25 | n/a | -22 | n/a | n/a | n/a | n/a | n/a | n/a | n/a | n/a | n/a | n/a | n/a | n/a |
| #2 | -42 | -39 | -36 | -33 | -30 | -27 | -24 | -21 | -19 | -18 | n/a | -16 | n/a | n/a | n/a | n/a | n/a | n/a | n/a | n/a | n/a | 5 |
| #3 | -38 | -35 | -32 | -29 | -26 | -23 | -20 | -17 | -15 | -14 | -13 | -12 | n/a | -10 | n/a | n/a | n/a | n/a | n/a | 3 | 6 | 9 |
| #4 | -34 | -31 | -28 | -25 | -22 | -19 | -16 | -13 | -11 | -10 | -9 | -8 | -7 | -6 | n/a | -4 | n/a | 0 | 2 | 4 | 6 | 8 |
| #5 | -30 | -27 | -24 | -21 | -18 | -15 | -12 | -9 | -7 | -6 | -5 | -4 | -3 | -2 | -1 | 0 | 2 | 5 | 8 | 11 | 14 | 17 |
| #6 | -26 | -23 | -20 | -17 | -14 | -11 | -8 | -5 | -3 | -2 | -1 | 0 | n/a | n/a | 3 | 4 | 6 | 9 | 12 | 15 | 18 | 21 |
| Position in Main Scanning Direction | Even | Odd | Even | Odd | Odd | Even | Odd | Even | Odd | Even | Odd | Even | Even | Odd | Even | Odd | Even | Odd | Even | Odd | Odd | Even |

Even means that dots of even numbers in the main scanning direction are recorded.
Odd means that dots of odd numbers in the main scanning direction are recorded.

METHOD AND APPARATUS FOR PRINTING WITH DIFFERENT SHEET FEEDING AMOUNTS AND ACCURACIES

BACKGROUND OF THE INVENTION

1. Field of the Invention

The present invention relates to a technique that forms raster lines while carrying out sub-scan to print an image, and more specifically to a technique of extending a printable area in which an image can be recorded.

2. Description of the Related Art

Typical examples of a printer that forms raster lines while carrying out sub-scan so as to print an image on a printing medium according to input image data include a line printer that forms raster lines without main scan, which moves a head forward and backward relative to the printing medium, and a serial scan printer and a drum scan printer that form raster lines with the main scan of the head. These printers, especially ink jet printers, use a nozzle array having a plurality of nozzles arranged in a sub-scanning direction for each color, with a view to enhancing the printing speed. The recent trend increases the number of nozzles arranged in the sub-scanning direction and thereby the size of the nozzle array, in order to attain the high-speed printing.

One recording method applied for such printers to improve the picture quality is the technique called the 'interlace method' disclosed in, for example, U.S. Pat. No. 4,198,642 and JAPANESE PATENT LAID-OPEN GAZETTE No. 53-2040. FIG. 21 shows an example of the interlace method. A variety of parameters used in the following description are explained first. In the example of FIG. 21, the number of nozzles N used for dot creation is equal to 3. A nozzle pitch k [dots] represents the ratio of an interval between the centers of adjoining nozzles on the print head to a dot pitch w of the resulting recorded image. In the example of FIG. 21, the nozzle pitch k is equal to 2. Since each raster line or main scanning line is recorded by one pass of the main scan in the example of FIG. 21, the number of repeated scans s is equal to 1. The number of repeated scans s represents the number of passes of the main scan that enable each raster line to be filled with dots. As described later, when the number of repeated scans s is equal to or greater than 2, each pass of the main scan records the dots in an intermittent manner in the main scanning direction. The symbol L in FIG. 21 represents the amount of sheet feeding in the sub-scan and corresponds to 3 raster lines in this example.

The circles including two digits represent the recorded positions of the dots. The left digit denotes the nozzle number, and the right digit denotes the order of recording (that is, which pass of the main scan records the dot).

In the interlace method shown in FIG. 21, the first pass of the main scan creates dots on the respective raster lines with the nozzles #2 and #3, whereas the nozzle #1 does not create any dots. After the sheet feeding of 3 raster lines, the second pass of the main scan forms raster lines with the nozzles #1 through #3. The subsequent procedure repeats the sheet feeding of 3 raster lines and formation of raster lines by the respective passes of the main scan, so as to complete an image. The nozzle #1 does not form a raster line in the first pass of the main scan, because no dots are created on an adjoining raster line located immediately below the raster line by the second or any subsequent pass of the main scan.

The interlace method forms raster lines in this intermittent manner in the sub-scanning direction to complete an image.

One major advantage of the interlace method is that the variations in nozzle pitch and ink spout characteristics can be dispersed on the resulting recorded image. Even if there are variations in nozzle pitch and ink spout characteristics, this method relieves the effects of the variations and thereby improves the picture quality. The example of FIG. 21 regards the case in which each raster line is formed by one pass of the main scan at a specific nozzle pitch. The interlace method is, however, applicable to a variety of settings. For example, the amount of sheet feeding may be varied arbitrarily according to the number of nozzles, and the number of repeated scans.

The interlace method is an extremely effective dot recording technique to improve the picture quality. This method, however, inevitably causes a non-printable area, in which an image can not be recorded, on the lower end of a printing medium when the recording starts from the upper end of the printing medium. FIG. 22 shows the state of dot creation according to the interlace method by the sheet feeding of 7 raster lines with a head having seven nozzles arranged at a nozzle pitch corresponding to 4 raster lines. The symbols P1, P2, . . . in FIG. 22 denote the passes of the main scan, for example, the first pass of the main scan and the second pass of the main scan. The circles including numerals represent the positions of the nozzles in the sub-scanning direction on each pass of the main scan. The encircled numerals denote the nozzle numbers. As a matter of convenience, raster numbers RN are allocated to the respective raster lines. The interlace method is adopted in this example, where each raster line is formed by one pass of the main scan at the respective nozzle positions.

FIG. 22 shows six passes of the main scan in the vicinity of the lower end of the printing medium. The nozzle #7 in the pass P6 of the main scan is located at the lower-end limit position of the nozzle according to the mechanism of sheet feeding. The sheet feeding mechanism is described with the drawing of FIG. 4.

The sheet feeding mechanism of the printer generally includes two pairs of rollers in a feeding section and a delivering section of the printing medium. In the example of FIG. 4, the rollers in the feeding section of the printing medium include a feeding roller 25*a* and a follower roller 25*b*, whereas the rollers in the delivering section of the printing medium include a delivering roller 27*a* and a star-wheel roller 27*b*. The accuracy of sheet feeding in the sub-scan is generally ensured by either one of the two pairs of rollers in the feeding section and in the delivering section. In the case where the rollers in the feeding section ensure the accuracy of sheet feeding, the limit of image recording with the sufficient accuracy of sub-scan is the position at which the lower end of the printing medium comes off the feeding roller 25*a* and the follower roller 25*b*. The distance between the lower end of the head and the lower end of the printing medium at this moment is determined according to the positions of the feeding roller 25*a* and the follower roller 25*b* and is equal to the distance 'a' shown in FIG. 4. The nozzle #7 in the pass P6 of the main scan in FIG. 22 corresponds to the nozzle at such a limit position.

When the image is recorded by the fixed amount of sheet feeding corresponding to 7 raster lines in this state, there is dropout of a raster line RN=−10 as shown in FIG. 22. Adoption of the interlace method accordingly causes the image to be recorded only up to the limit of an area A shown in FIG. 22. According to the combination of sheet feeding amounts in the interlace method, the printable area may be reduced to the position of the nozzle #1 in the pass P6 of the main scan (that is, the area of RN≦−17) in the worst case.

When the head has a width 'h' in the sub-scanning direction, there is a non-printable area corresponding to the distance 'a+h' from the lower end of the printing medium as shown in FIG. 4. The non-printable area is further extended, because the possible errors in sheet feeding require some additional margin.

The non-printable area is negligible in the case of a relatively small-sized nozzle array, that is, when the width 'h' of the head shown in FIG. 4 is relatively small. The recent trend that increases the size of the nozzle array, however, results in a significantly large non-printable area. The large non-printable area significantly damages the advantages of the printer that records the image of high picture quality at a high speed.

After the printing medium comes off the rollers in the feeding section that ensure the accuracy of sheet feeding in the sub-scan, it is possible to continue the sub-scan with the rollers in the delivering section that give only the lower accuracy of sheet feeding. One possible procedure reduces the non-printable area by forming raster lines while carrying out such sheet feeding with the lower accuracy. For example, the pass P7 of the main scan shown in FIG. 22 solves the problem of dropout of raster lines and extends the printable area of the image. In principle, this technique enables the image to be recorded to the lower end of the printing medium.

The dot recording with the lower accuracy of sheet feeding in the sub-scan naturally lowers the picture quality. This technique does not extend at all the high-quality image recording area that enables image recording with high picture quality, and is thereby not an essential solution. Similar problems arise in the case where the rollers in the delivering section ensure the accuracy of sheet feeding. In this case, there is a large non-printable area on the upper end of the printing medium, which is formed before the upper end of the printing medium fed by the rollers in the feeding section reaches the rollers in the delivering section. These problems also arise in the printers that form raster lines without the main scan of the head.

SUMMARY OF THE INVENTION

The object of the present invention is thus to provide a technique of dot creation by the interlace method, which enables extension of the printable area, in which an image is recorded, by carrying out formation of raster lines even in the state of sub-scan with lower accuracy of sheet feeding, as well as extension of the high-quality image recording area where the resulting printed image has sufficiently high picture quality.

At least part of the above and the other related objects is realized by a printer that forms a plurality of raster lines with a head, each raster line comprising an array of dots aligned in a raster-forming direction, which is one direction of a printing medium, and carries out a sub-scan that moves said head in a sub-scanning direction relative to said printing medium, which is another direction crossing the raster-forming direction, thereby printing an image corresponding to input image data on the printing medium. The printer includes: the head having n nozzles that can create dots of an identical color and are arranged in the sub-scanning direction at a fixed interval, where n denotes an integer of not less than 2; a raster-forming unit that drives the head to form the plurality of raster lines; a first sub-scan unit that carries out the sub-scan with a first accuracy; a second sub-scan unit that carries out the sub-scan with a second accuracy, which is lower than the first accuracy, when the printing medium is located at a position that does not allow the first sub-scan unit to carry out the sub-scan; a first control unit that controls the first sub-scan unit and the raster-forming unit in a first area where the first sub-scan unit carries out the sub-scan to record the image; and a second control unit that controls the second sub-scan unit and the raster-forming unit in a second area where the second sub-scan unit carries out the sub-scan to record the image. The first control unit causes the first sub-scan unit to carry out the sub-scan by a first feeding amount that allows adjoining raster lines to be formed with different nozzles in a predetermined section of the first area that does not adjoin to the second area and to carry out the sub-scan by a second feeding amount, which is smaller than the first feeding amount, in a middle area that adjoins both to the predetermined section of the first area and to the second area.

In the printer of the present invention, the printable area, in which an image can be recorded, is divided into three areas, that is, the first area, the second area, and the middle area that is adjacent to both the first area and the second area. These areas are arranged in the sequence of the first area, the middle area, and the second area in the sub-scanning direction or alternatively in the reverse sequence. The accuracy of sub-scan in the second area is lower than those in the first area and the middle area. Such a difference in accuracy of sub-scan is ascribed to the mechanism of sub-scan in the printer. In the first area, the sub-scan is carried out to form each raster line with different nozzles. The amount of sub-scan in the middle area is smaller than the amount of sub-scan in the first area.

The effects of the printer are discussed in the example where the first area, the middle area, and the second area are arranged in this sequence in the sub-scanning direction. In the first area, the dot creation with the sub-scan of the first feeding amount effectively disperses the positional deviation of dots, due to the mechanical errors of the nozzle in the manufacturing process and the errors of sheet feeding in the sub-scan, thereby ensuring the image of high picture quality. In the middle area that adjoins to the first area and enables dot creation with the same accuracy of sheet feeding as that in the first area, the procedure records the image while carrying out the sub-scan by the second feeding amount, which is smaller than the first feeding amount. This enables the high-quality image recording area that ensures recording of the image with the high quality equivalent to that in the first area to be extended in the sub-scanning direction. The arrangement of this embodiment further enables the image to be recorded in the second area that adjoins to the middle area, thereby further extending the printable area.

In the printer of the present invention, when the printable area is extended by recording the image in the second area with the lower accuracy of sub-scan, which is due to the mechanism of the printer, the dot creation in the middle area extends the high-quality image recording area that ensures the high picture quality of the resulting image.

In accordance with one preferable application of the printer, the second area is apart from the first area in the sub-scanning direction. The fixed interval of the nozzles mounted on the head is p times an interval between adjoining raster lines in the sub-scanning direction, where p denotes an integer of not less than 2. The sub-scan in the middle area completes the image up to a specific raster line, which is closer to the first area by m raster lines than a limit raster line that allows dot creation with the first accuracy, where m denotes an integer of less than $p\times(n-1)$.

In the case where the sub-scanning mechanism of the printer causes the end nozzle on the head to be present at the position of the limit raster line that enables dot creation with the first accuracy, the printer of this preferable structure completes the image up to the raster lines formed by part of the nozzles mounted on the head. The high-quality image recording area where the dot creation is carried out with the first accuracy is accordingly extended by these raster lines.

In the printer of the above structure, it is preferable that the sub-scan in the middle area causes adjoining raster lines to be formed with different nozzles.

In the printer of this structure, the adjoining raster lines are formed with different nozzles. This arrangement enables the positional deviation of the dots, due to the mechanical errors of the nozzles in the manufacturing process and the errors of sheet feeding in the sub-scan, to be dispersed in the middle area, thereby improving the picture quality.

In the printer of the above structure, it is also preferable that the sub-scan in the middle area has a feeding amount of one raster line.

In the printer of this preferable arrangement, the high-quality image recording area where the dot creation is carried out with the first accuracy is extended to the maximum level in the middle area. This is because the adoption of the fine sheet feeding of one raster line for the sub-scan in the middle area complete the image up to the position of the limit raster line that enables dot creation with the first accuracy.

A variety of units may be applicable for the first sub-scan unit and the second sub-scan unit in the printer of the present invention. For example, each of the first sub-scan unit and the second sub-scan unit includes rollers for feeding the printing medium. The frictional force applied by the rollers to the printing medium is higher in the first sub-scan unit than in the second sub-scan unit.

The mechanism of feeding the printing medium by the rollers is known to the art. The arrangement of the present invention is effectively applicable to the printer where frictional forces of different magnitudes are applied to the printing medium. By way of example, the first sub-scan unit includes rollers with a member that enhances the frictional force, and the second sub-scan unit includes rollers having the smaller contact area with the printing medium.

In the printer of the present invention, when the head is the type that spouts ink and creates dots, the first sub-scan unit may be disposed before the head while the second sub-scan unit is disposed after the head.

In this structure, the second-sub scan unit with the relatively lower accuracy is disposed at the position after the ink has been jetted on the printing medium. This arrangement enables the sub-scan while protecting the printing surface on which ink has not yet been dried completely. By way of example, the second sub-scan unit includes rollers having the smaller contact area with the printing medium.

The present invention is also directed to a method of forming a plurality of raster lines with a head, each raster line including an array of dots aligned in one direction of a printing medium or in a raster-forming direction, and carrying out a sub-scan that moves the head in another direction crossing the raster-forming direction or in a sub-scanning direction relative to the printing medium, thereby printing an image corresponding to input image data on the printing medium. The head has n nozzles that can create dots of an identical color and are arranged in the sub-scanning direction at a fixed interval, where n denotes an integer of not less than 2. The method includes the steps of: (a) carrying out the sub-scan with a first accuracy to record the image in a first area on the printing medium; and (b) carrying out the sub-scan with a second accuracy, which is lower than the first accuracy, to record the image in a second area where the sub-scan with the first accuracy is not allowable. The step (a) carries out the sub-scan by a first feeding amount that allows adjoining raster lines to be formed with different nozzles in a predetermined section of the first area that does not adjoin to the second area, and carries out the sub-scan by a second feeding amount, which is smaller than the first feeding amount in a middle area that adjoins to both the predetermined section of the first area and the second area.

The method of the present invention exerts the same effects as those of the printer discussed above and extends the printable area, in which the image is recorded, while ensuring the sufficiently high picture quality of the resulting image.

The printer of the present invention maybe realized by causing the computer to control the head for dot creation according to a preset program. Another application of the present invention is thus a recording a medium in which such a program is recorded.

The present invention is accordingly directed to a recording medium, in which a program for causing a printer to form raster lines and carry out a sub-scan in order to print an image corresponding to image data on a printing medium is recorded in a computer readable manner. The program causes a computer to carry out the functions of: dividing a printable area, in which the image can be recorded, into a first area where the sub-scan is carried out with a first accuracy and a second area where the sub-scan is carried out with a second accuracy, which is lower than the first accuracy; outputting a first control signal to carry out the sub-scan by a predetermined first feeding amount that allows adjoining raster lines to be formed with different nozzles in a predetermined section of the first area that does not adjoin to the second area; outputting a second control signal to carry out the sub-scan by a second feeding amount, which is smaller than the first feeding amount, in a middle area that adjoins both to the predetermined section of the first area and to the second area; and outputting the control signals for recording the image in the sequence of the sub-scan.

The computer executes the program recorded in the recording medium, so as to actualize the printer of the present invention discussed above.

Available examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. Still another application is a program supply apparatus that supplies a computer program, which causes the computer to actualize the control functions of the printer, to the computer via a communications path.

All the arrangements of the present invention described above are applicable not only to the printer that forms raster lines through the main scan, which moves the head forward and backward relative to the printing medium, but to the printer that forms raster lines without the main scan.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 12 is a table showing the raster lines formed by the respective nozzles in each pass of the main scan in the state of FIG. 11;

FIGS. 13 and 14 are tables showing the raster lines formed by the respective nozzles in each pass of the main scan in the actual state of dot creation in the first embodiment;

FIG. 16 is a table showing the raster lines formed by the respective nozzles in each pass of the main scan in the state of FIG. 15;

FIG. 18 is a table showing the raster lines formed by the respective nozzles in each pass of the main scan in the state of FIG. 17;

DESCRIPTION OF THE PREFERRED EMBODIMENTS (1) Structure of Apparatus

Figure 1:
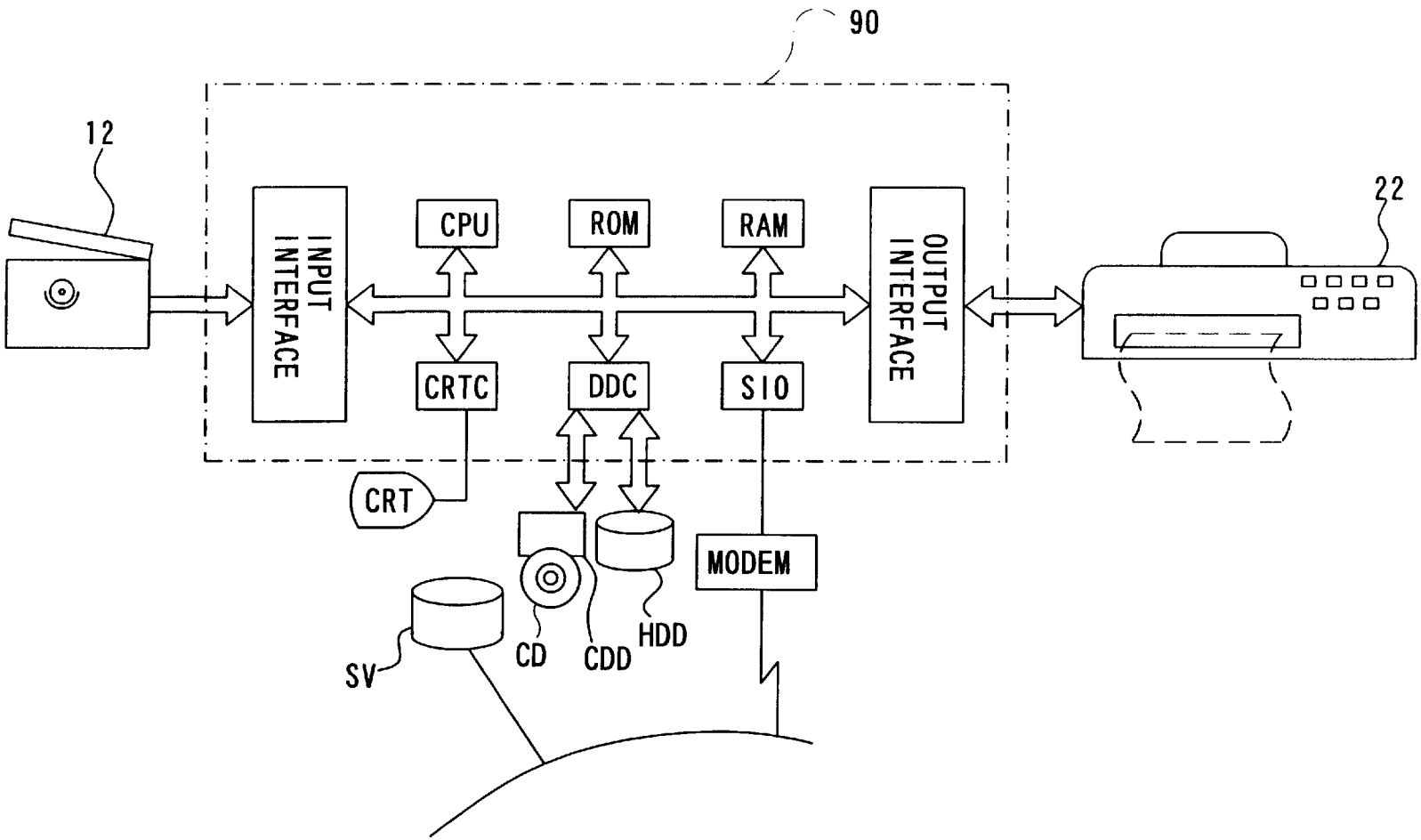
FIG. 1 is a block diagram illustrating the structure of a printing system including a printer 22 embodying the present invention.

FIG. 1 is a block diagram illustrating the structure of a printing system including a printer embodying the present invention. The printing system includes a computer 90 connected to a scanner 12 and a color printer 22. The printer 22 corresponds to the printer of the present invention. The computer 90 reads a program required for driving the printer 22 from a CD-ROM drive CDD or a flexible disk drive (not shown). The computer 90 is connected to an external network via a modem and can download a program required for driving the printer 22 from a specific server SV into a hard disk HDD.

Figure 2:
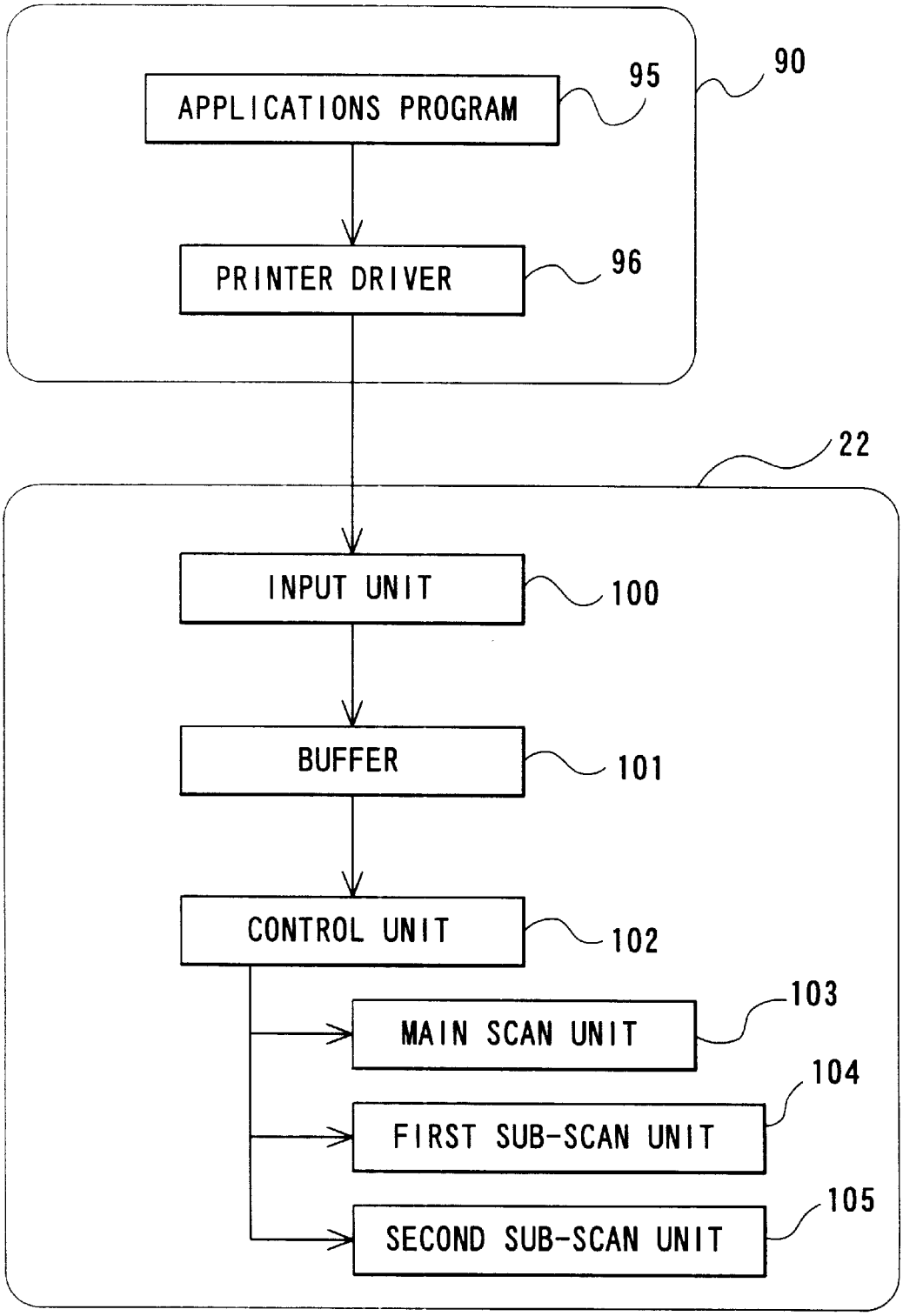
FIG. 2 is a block diagram illustrating the software structure of the printing system.

FIG. 2 is a block diagram illustrating the software structure of the printing system. In the computer 90, an applications program 95 for generating image information to be printed works under a predetermined operating system. When the applications program 95 issues a printing command, a printer driver 96 incorporated in the operating system receives the image information from the applications program 95, converts the image information into print data printable by the printer 22, and outputs the print data to the printer 22. According to a concrete procedure, the printer driver 96 carries out color correction to convert the R, G, and B color components of the image information supplied from the applications program 95 into ink colors C, M, Y, and K used by the printer 22. The printer driver 96 also performs halftone processing to express the tone by the dispersibility of dots.

In the printer 22, the print data output from the printer driver 96 is input into an input unit 100 and stored in a buffer 101. A control unit 102 of the printer 22 reads the print data from the buffer 101 and controls a main scan unit 103 to form raster lines. The control unit 102 also controls a first sub-scan unit 104 and a second sub-scan unit 105 to carry out sub-scans. The first sub-scan unit 104 carries out the sub-scan by a predetermined first feeding amount of relatively high accuracy, whereas the second sub-scan unit 105 carries out the sub-scan by a predetermined second feeding amount of relatively low accuracy. The appropriate feeding amount out of the two alternatives is preset according to the positional relationship between the printing medium and the printing area.

Figure 3:
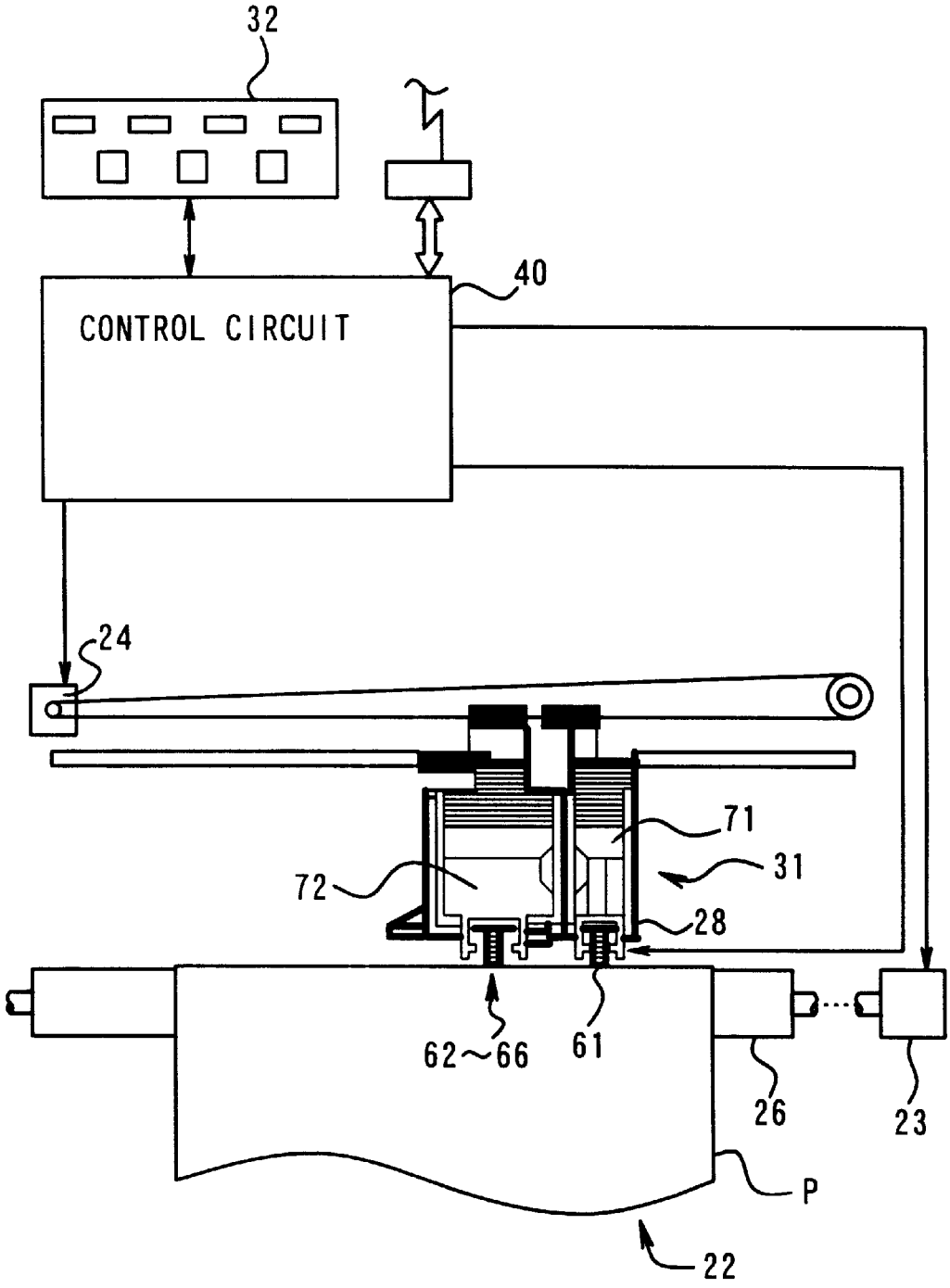
FIG. 3 schematically illustrates the structure of the printer 22 in this embodiment.

The schematic structure of the printer 22 is described with the drawing of FIG. 3. As illustrated in FIG. 3, the printer 22 has a mechanism for causing a sheet feed motor 23 to feed a sheet of printing paper P, a mechanism for causing a carriage motor 24 to move a carriage 31 forward and backward along an axis of a platen 26, a mechanism for driving a print head 28 mounted on the carriage 31 to control spout of ink and creation of dots, and a control circuit 40 that controls transmission of signals to and from the sheet feed motor 23, the carriage motor 24, the print head 28, and a control panel 32.

Figure 4:
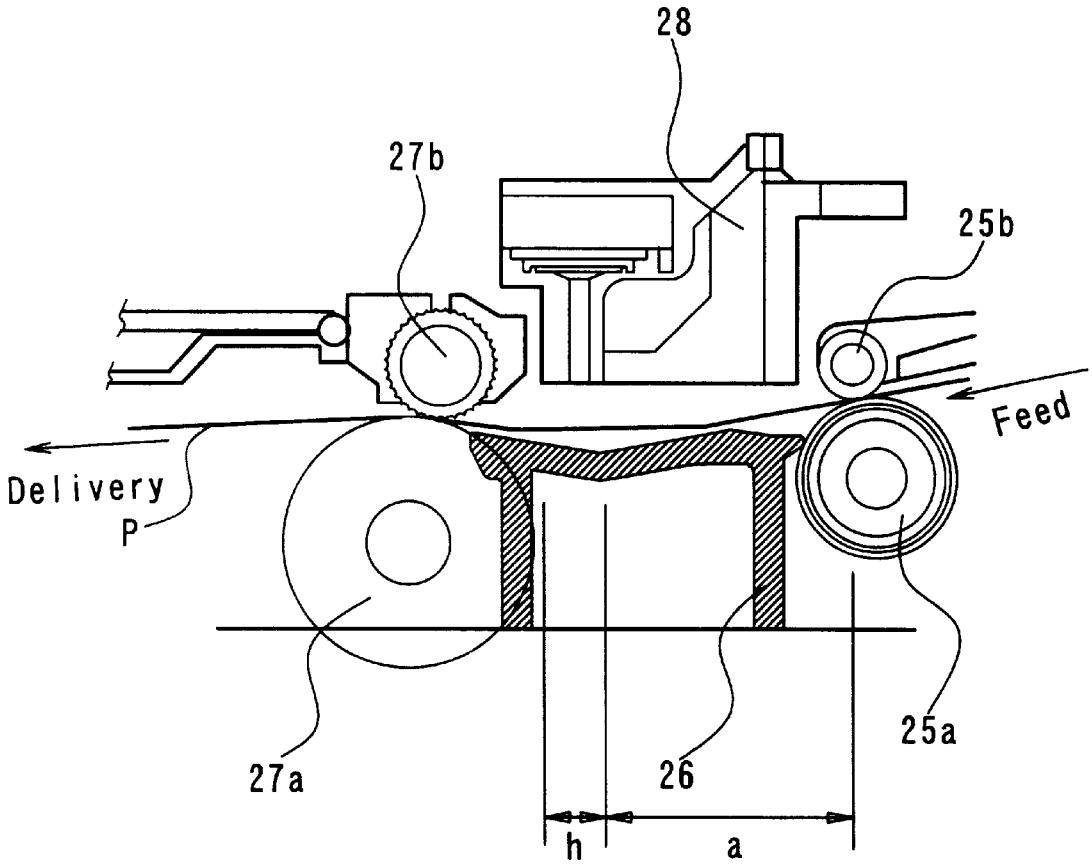
FIG. 4 shows a sheet feeding mechanism in the printer 22 of the embodiment.

The mechanism of feeding the printing paper P in the printer 22 is described with the side sectional view of FIG. 4. The mechanism of feeding the printing paper P includes a feeding roller 25*a* and a follower roller 25*b* disposed in a feeder section and a delivering roller 27*a* and a star-wheel roller 27*b* disposed in a delivery section. These rollers are driven by the rotation of the sheet feed motor 23 shown in FIG. 3. Referring to FIG. 4, the printing paper P is interposed between the feeding roller 25*a* and the follower roller 25*b* and fed from the feeder section with the rotations of these rollers 25*a* and 25*b*. When the upper end of the printing paper P reaches the position between the delivering roller 27*a* and the star-wheel roller 27*b*, these rollers 27*a* and 27*b* cooperate to feed the printing paper P to the delivery section. The head 28 records an image in a specific area of the printing paper P that is located over the platen 26.

The rollers 25*a* and 25*b* in the feeder section ensure the accuracy of sheet feeding. When the printing paper P is fed only by the delivering roller 27*a* and the star-wheel roller 27*b* after the lower end of the printing paper P comes off the feeding roller 25*a* and the follower roller 25*b*, the accuracy of sheet feeding is accordingly lowered.

A black ink cartridge 71 for black ink (Bk) and a color ink cartridge 72, in which five color inks, that is, cyan (C1), light cyan (C2), magenta (M1), light magenta (M2), and yellow (Y), are accommodated, may be mounted on the carriage 31. A total of six ink spout heads 61 through 66 are formed on the print head 28 that is disposed in the lower portion of the carriage 31.

Figure 5:
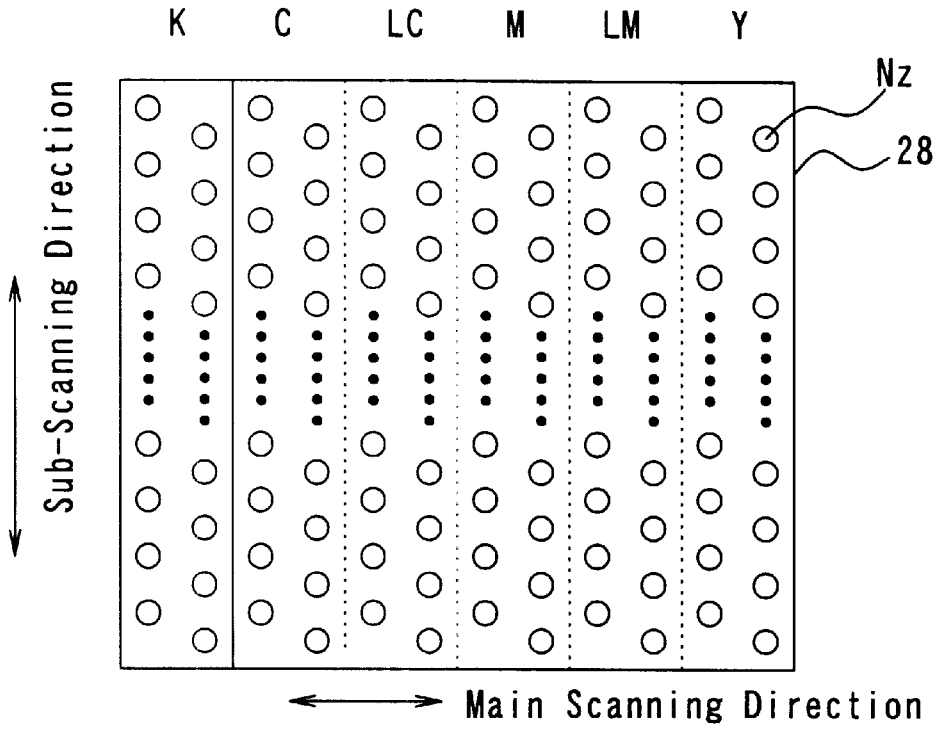
FIG. 5 shows an arrangement of nozzle arrays in the printer 22 of the embodiment.

FIG. 5 shows an arrangement of ink jet nozzles Nz on the ink spout heads 61 through 66. The nozzle arrangement includes six nozzle arrays, wherein each nozzle array spouts ink of each color and includes forty-eight nozzles Nz arranged in zigzag at a fixed nozzle pitch k. The positions of the corresponding nozzles in a sub-scanning direction are identical in the respective nozzle arrays.

A piezoelectric element PE is arranged for each nozzle Nz in the ink spout heads 61 through 66. Application of a voltage to the piezoelectric element PE for a predetermined time period causes the piezoelectric element PE to extend and deform an ink conduit for feeding a supply of ink to each nozzle, which results in jetting an ink particle out. Another technique may be applied to spout the ink. One applicable method supplies electricity of a heater disposed in an ink conduit and causes ink to be jetted out with bubbles generated in the ink conduit.

Figure 6:
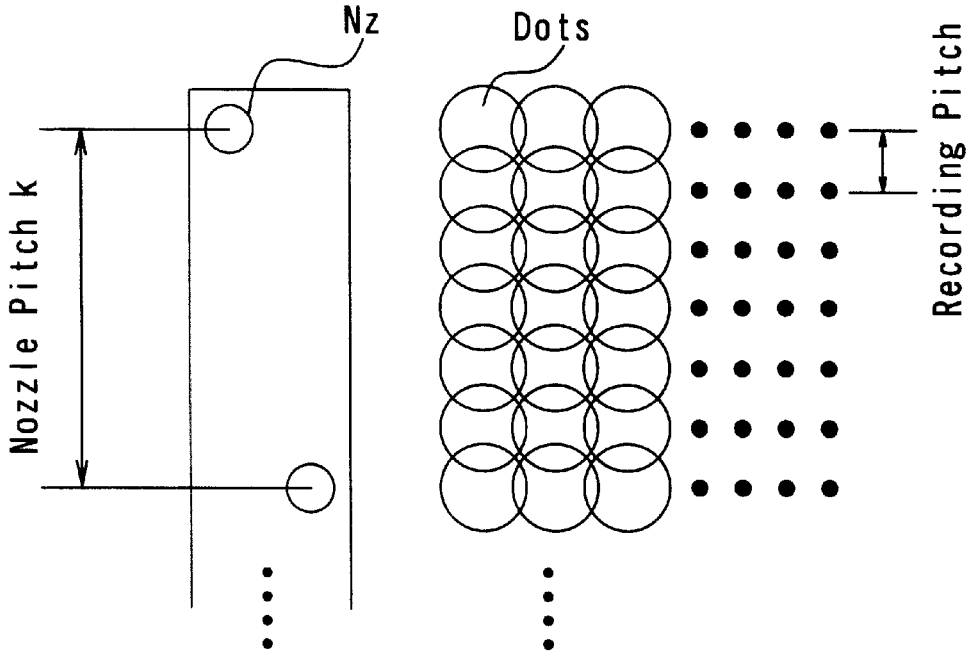
FIG. 6 shows an enlarged part of the nozzle array and dots created by the nozzle array.

FIG. 6 shows an enlarged part of the nozzle array and dots created by the nozzle array. Sub-scans of the nozzle array enable dots to be recorded at a recording pitch that is ⅙ of the nozzle pitch as shown in FIG. 6. Namely the ratio of the nozzle pitch to the recording pitch is 6 to 1 in this embodiment. In order to prevent dropout of a dot, each dot is recorded to partly overlap the adjoining dots both in the main scanning direction and in the sub-scanning direction.

Figure 7:
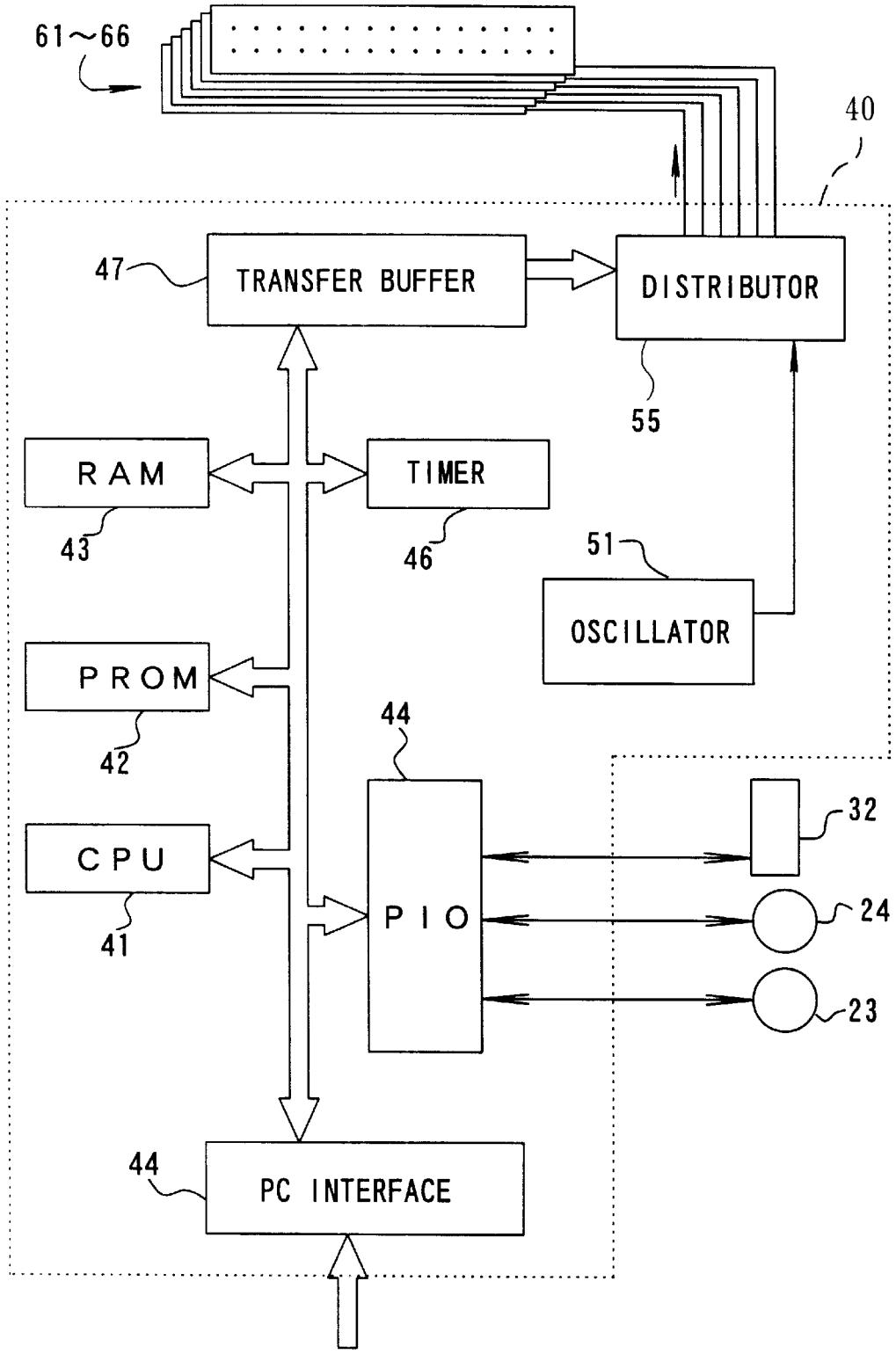
FIG. 7 shows the internal structure of the control circuit 40 in the printer 22.

The following describes the internal structure of the control circuit 40 in the printer 22 and the method of driving the print head 28 with the plurality of nozzles Nz shown in FIG. 5. FIG. 7 illustrates the internal structure of the control circuit 40. Referring to FIG. 7, the control circuit 40 includes a CPU 41, a PROM 42, a RAM 43, a PC interface 44 that transmits data to and from the computer 90, a peripheral input-output unit (PIO) 45 that transmits signals to and from the sheet feed motor 23, the carriage motor 24, and the control panel 32, a timer 46 that counts the time, and a transfer buffer 47 that outputs ON-OFF signals of dots to the ink spout heads 61 through 66. These elements and circuits are mutually connected via a bus 48. The control circuit 40 further includes an oscillator 51 that outputs driving waveforms at a predetermined frequency and a distributor 55 that distributes the output of the oscillator 51 into the ink spout heads 61 through 66 at a specified timing. The control circuit 40 receives print data processed by the computer 90 and stores the print data into the transfer buffer 47. The ON-OFF state of each nozzle in the ink spout heads 61 through 66 is set, based on the data output from the transfer buffer 47 to the distributor 55. The nozzle set in the ON state spouts an ink particle, in response to a driving waveform output from the oscillator 51.

In the printer 22 having the hardware structure discussed above, while the sheet feed motor 23 rotates the rollers 25*a* and 25*b* in the feeder section and the other related rollers to feed the printing paper P (hereinafter referred to as the sub-scan), the carriage motor 24 moves the carriage 31 forward and backward (hereinafter referred to as the main scan), simultaneously with actuation of the piezoelectric elements PE on the respective ink spout heads 61 through 66 of the print head 28. The printer 22 accordingly sprays the respective color inks to create dots and thereby form a multi-color image on the printing paper P.

(2) Dot Creation Control

Figure 8:
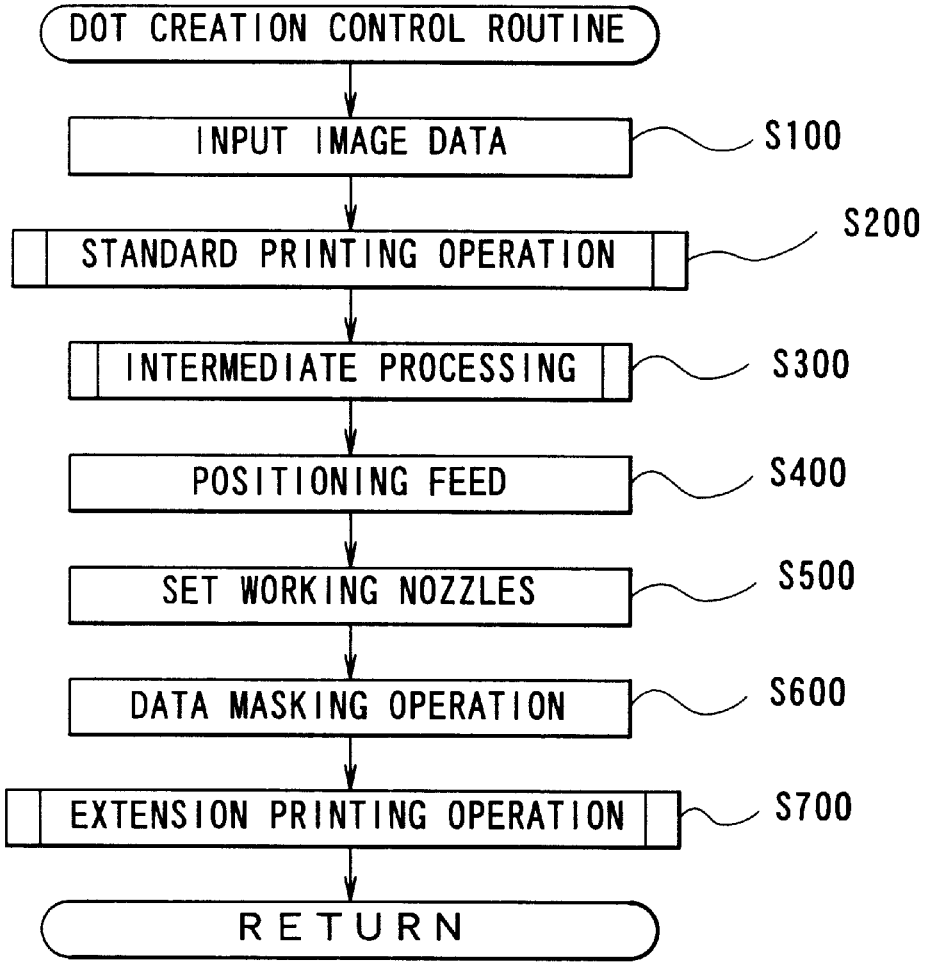
FIG. 8 is a flowchart showing a dot creation control routine executed in the first embodiment.
Figure 9:
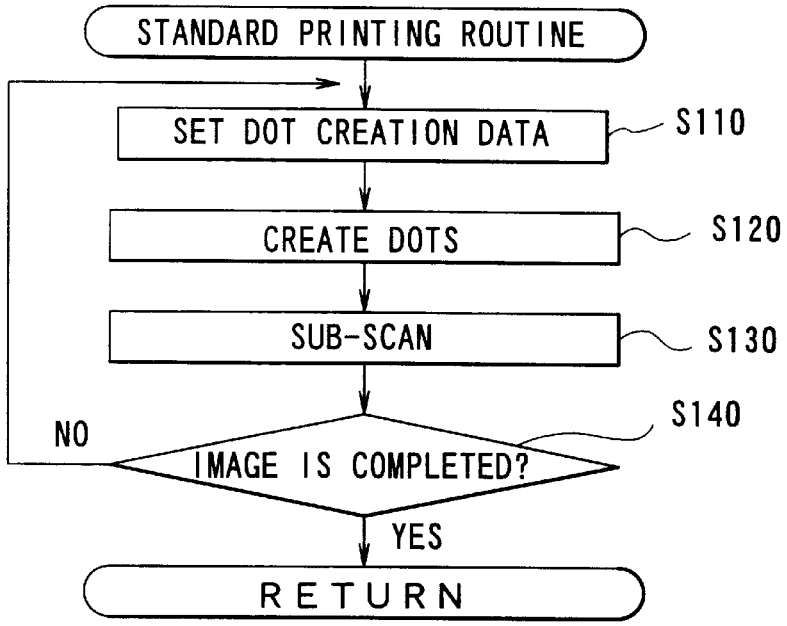
FIG. 9 is a flowchart showing a standard printing routine executed at step S200 in the flowchart of FIG. 8.

The following concretely describes a process of creating dots and recording an image through the main scan of the head and the sub-scan of the printing paper in the printer 22 of this embodiment. FIGS. 8 and 9 are flowcharts showing a dot creation control routine to control the main scan and the sub-scan executed in this embodiment. The CPU 41 of the control circuit 40 in the printer 22 shown in FIG. 3 executes the dot creation control routine to implement the control.

When the program enters the dot creation control routine of FIG. 8, the CPU 41 first inputs image data at step S100. The image data have been subjected to color correction and other image processing operations carried out by the printer driver 96, and specify the positions of the respective color dots to be created in the main scanning direction and in the sub-scanning direction on the printing paper. In this embodiment, the procedure of step S100 inputs all the data relating to an image to be printed. Another possible application successively inputs data while creating the required dots.

Figure 10:
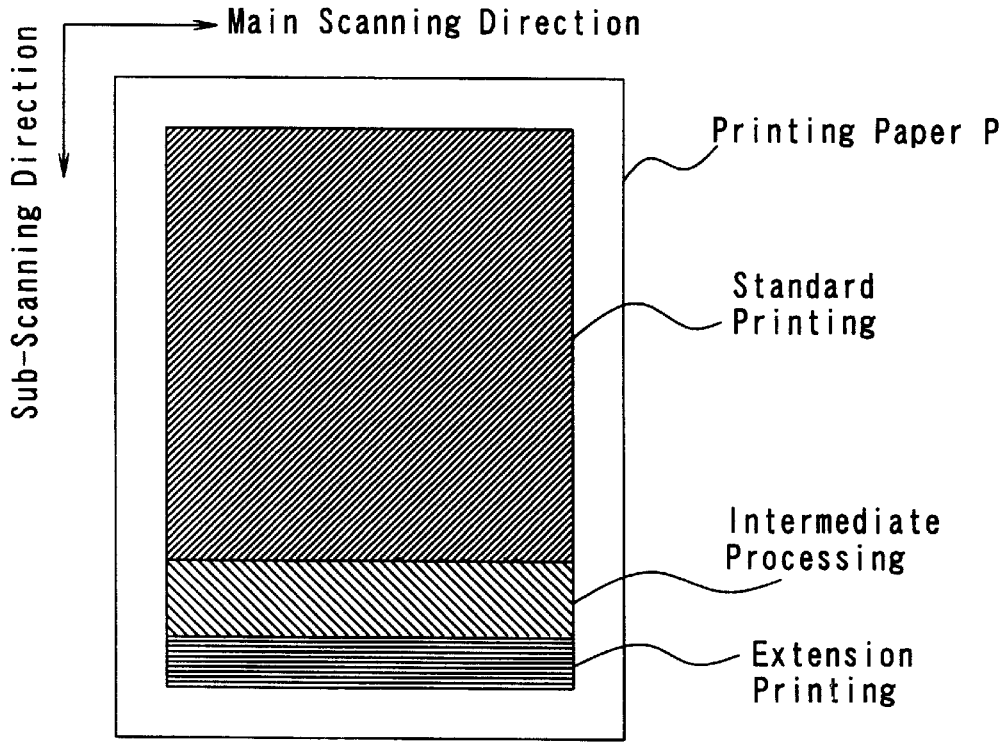
FIG. 10 shows a printable area, in which an image is recorded, in this embodiment.

The CPU 41 then carries out a standard printing operation to record an image at step S200. The standard printing operation in this embodiment adopts the interlace method. The flowchart of FIG. 9 shows the routine of the standard printing operation executed at step S200 in the flowchart of FIG. 8. FIG. 10 shows a printable area, in which an image is recorded, in this embodiment. The printable area is divided into three areas, based on the positional relationship between the sheet feeding mechanism and the printing paper P shown in FIG. 4.

The first area is the area of standard printing shown in FIG. 10. The image in the first area is recorded in the state that the printing paper P is fed by the feeding roller 25*a* and the follower roller 25*b* shown in FIG. 4, that is, in the state that the sufficient accuracy of sheet feeding is ensured. The second area is the area of intermediate processing shown in FIG. 10. This corresponds to a transient area located between the area of standard printing and the third area described below. The sufficient accuracy of sheet feeding is also ensured in this second area. The third area is the area of extension printing shown in FIG. 10. The image in the third area is recorded in the state that the lower end of the printing paper P comes off the feeding roller 25*a* and the follower roller 25*b* and the printing paper P is fed by the delivering roller 27*a* and the star-wheel roller 27*b*. The image is thus recorded with lower accuracy of sheet feeding in the area of extension printing than in the area of standard printing and the area of intermediate processing. The printer 22 of this embodiment can record, in principle, an image over the whole area of the printing paper P. There are, however, some margins set by taking into account the errors in size of the printing paper P and in printing area at the time of insertion of the printing paper P into the printer 22.

Figure 11:
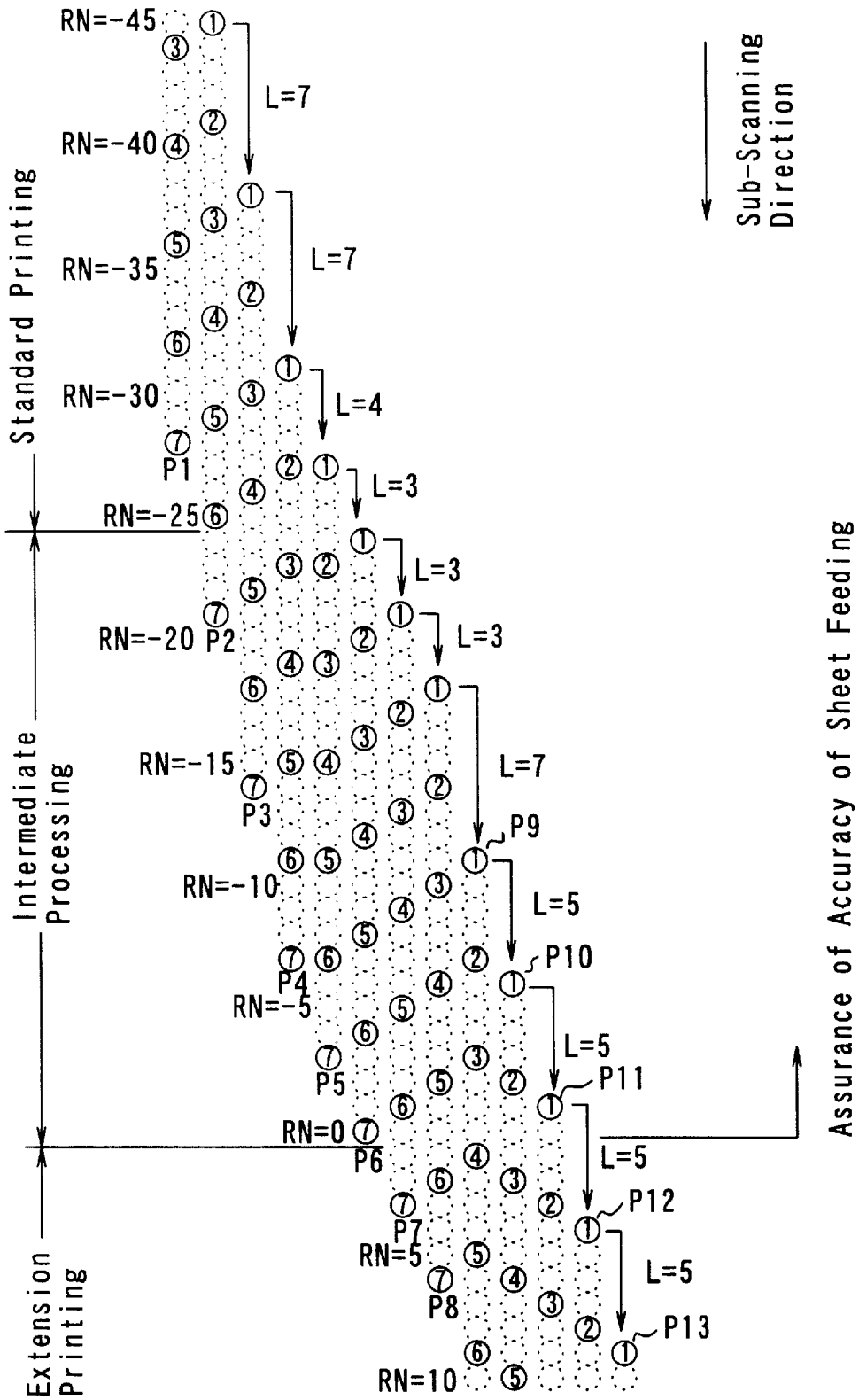
FIG. 11 shows the state of dot creation in the first embodiment.

FIG. 11 shows the state of dots created according to the dot creation control procedure shown in the flowcharts of FIGS. 8 and 9. FIG. 12 is a table showing the raster lines formed by the respective nozzles in each pass of the main scan in the state of FIG. 11. For convenience of explanation, the nozzle pitch is set equal to 4 raster lines and the number of nozzles is reduced to 7 in the example of FIGS. 11 and 12.

FIG. 11 shows the positions of the nozzles in the sub-scanning direction on each pass of the main scan. The vertical direction of FIG. 11 corresponds to the sub-scanning direction. For simplicity of illustration, the positions of the nozzles shown in FIG. 11 are successively shifted rightward by every pass of the main scan. The symbols P1, P2, . . . in FIG. 11 denote the passes of the main scan, for example, the first pass of the main scan and the second pass of the main scan. The circles including numerals represent the positions of the nozzles in the sub-scanning direction on each pass of the main scan. The numerals included in thick circles denote the nozzle numbers in the state that dots are created at the corresponding positions by the nozzles, whereas the numerals included in thin circles denote the nozzle numbers in the state that no dots are created by the nozzles located there. As a matter of convenience, raster numbers RN are allocated to the respective raster lines. The raster number 0 (RN=0) is assigned to the lower-most raster line that is recorded by this recording process while the sufficient accuracy of sheet feeding in the sub-scan is ensured. Positive numbers are assigned to the lower raster lines below the raster line RN=0, whereas negative numbers are assigned to the upper raster lines. Each value L denotes the amount of sheet feeding in each sub-scan expressed as the number of raster lines.

When the program enters the standard printing routine shown in the flowchart of FIG. 9, the CPU 41 sets dot creation data at step S110 and creates dots while carrying out the main scan at step S120. In the example of FIG. 11, the nozzle pitch corresponds to 4 raster lines, so that the dot creation data are provided by successively extracting the input image data on every fourth raster line from the head in the main scanning direction. The CPU 41 transfers the dot creation data thus obtained to the transfer buffer 47 shown in FIG. 7. The CPU 41 drives the head 28 to spout ink and create dots in response to the driving waveform, which is output synchronously with the position of the head 28 in the main scanning direction. In the course of the pass P1 of the main scan shown in FIG. 11, dots are created on every fourth raster line in the area above the raster line RN=−28 (that is, the area of PN≦−28).

The table of FIG. 12 shows the raster numbers corresponding to the nozzle positions in each pass of the main scan. The numbers #1, #2, . . . , in the left-most column of FIG. 12 correspond to the respective nozzle numbers in FIG. 11, and the symbols P1, P2 . . . in the upper-most row of FIG. 12 correspond to the symbols P1, P2 . . . representing the respective passes of the main scan in FIG. 11. The values in the table show the raster numbers allocated to the raster lines formed by the respective nozzles in each pass of the main scan. For example, the nozzle #1 forms a raster line RN=−52 in the pass P1 of the main scan. The raster line RN=−52 is included in the area above the area shown in FIG. 11.

The CPU 41 subsequently controls the sheet feed motor 23 to carry out the sub-scan at step S130. The method of sheet feeding is described previously with the drawing of FIG. 4. In the example of FIG. 11, the position of the head 28 is moved to the pass P2 of FIG. 11 by the sheet feeding of 7 raster lines. The optimum amount of sheet feeding that enables the nozzles to be used most effectively is selected among alternative amounts of sheet feeding that enable an image to be recorded with no dropout of raster lines by the interlace method. The amount of sheet feeding is determined according to the nozzle pitch, the number of nozzles, and the number of repeated scans. The details of the determination are known in the art and are thus not specifically described here.

After the sub-scan, the program repeats the processing of steps S110 through S130 to create the dots at the positions shown by the pass P2 of main scan of FIG. 11, that is, in the area above the raster line RN=−20. The repetition of the processing enables raster lines to be formed in an intermittent manner and thereby records a desired image. By way of example, the execution of the passes P1 through P4 of the main scan complete the image in the area of the raster lines RN=−34 through RN=−25 as clearly understood from FIG. 11. The processing is repeated until the image is completed at step S140. In this embodiment, however, printing in a different print mode is carried out after the standard printing operation (step S200 in the flowchart of FIG. 8) as described later. The completion of the image here accordingly does not mean the completion of printing of the whole input image data, but implies the completion of the image according to the standard printing routine.

Completion or non-completion of the image by the standard printing operation is determined according to the number of raster lines to be formed by the intermediate processing (step S300 in the flowchart of FIG. 8) and by the extension printing operation (step S700). In the case where the size of the printing paper P is specified in advance, both the total number of raster lines in the input image data and the number of raster lines to be formed by the intermediate processing and by the extension printing operation are known. The number of raster lines, starting from the upper end of the image data, to be formed by the standard printing operation is thus determined, based on these pieces of information. Comparison between the expected number of raster lines and the number of raster lines actually formed readily determines whether or not the standard printing operation is to be concluded. The structure of the embodiment gives some margin to the area of standard printing. This is because the size of the printing paper P is not strictly identical and there may be an error in printing area due to the slippage at the time of insertion of the printing paper P into the printer 22 and other factors.

In the case where the size of the printing paper P is unknown, one modification of the embodiment provides a sensor, which is disposed at a predetermined position before the feeding roller 25*a* and the follower roller 25*b* of FIG. 4 to detect the end of the printing paper P, and determines conclusion or non-conclusion of the standard printing operation, based on the information from the sensor. For example, a known optical sensor may be used to detect the end of the printing paper P. At the time when the end of the printing paper P is detected, known are the distance between the position in which printing is currently curried out and the lower end of the printing paper P and thereby the number of raster lines to be recorded in the corresponding area. The method determines completion or non-completion of the image by the standard printing operation, based on these pieces of information.

After completion of the image by the standard printing operation, the CPU 41 carries out printing of the image by the intermediate processing at step S300 in the flowchart of FIG. 8. The basic flow of dot creation by the intermediate processing is similar to that of the standard printing routine shown in the flowchart of FIG. 9 and is thus not specifically illustrated. The difference between the intermediate processing and the standard printing operation is the amount of sheet feeding in the sub-scan.

Different from the sheet feeding of 7 raster lines in the standard printing operation, the intermediate processing of step S300 first carries out the sheet feeding of 4 raster lines and forms a raster line in the pass P5 of the main scan of FIG. 11. The meaning of this sheet feeding amount corresponding to 4 raster lines will be described later. The intermediate processing then carries out the sheet feeding of 3 raster lines and forms raster lines in the passes P6 through P8 of the main scan of FIG. 11. Like the nozzle #1 in the pass P7 of the main scan, the nozzles may be present at the positions where dots of the raster line have already been created. The dot creation data are masked for such nozzles, in order to interfere with further creation of dots at the positions. The symbol n/a in the table of FIG. 12 denotes the nozzle for which the dot creation data is masked. The position of the pass P8 of the main scan in FIG. 11 represents the limit position that carries out sheet feeding while ensuring the sufficient accuracy. Namely this is the state immediately before the lower end of the printing paper P comes off the feeding roller 25*a* and the follower roller 25*b*. In this embodiment, the position of the pass P8 of the main scan is determined by adding a margin of 2 millimeters to the actual limit position.

The following describes the settings of the sheet feeding amount in the intermediate processing. The intermediate processing of the embodiment carries out the sheet feeding by a fixed amount of 3 raster lines, which follows a transient feed of 4 raster lines. The fixed amount of sheet feeding corresponds to the amount of sheet feeding in the process of interlace printing with three nozzles arranged at the nozzle pitch of 4 raster lines. In the intermediate processing of this embodiment, the amount of sheet feeding is set to carry out recording by the interlace method with three out of the seven nozzles. In the pass P8 of the main scan of FIG. 11, only three nozzles, the nozzles #3 through #5, create dots. More than 3 nozzles are used in the passes P6 and P7 of the main scan. This arrangement ensures smooth connection with the area of the standard printing and thereby prevents dropout of raster lines. The transient feed of 4 raster lines in the beginning of the intermediate processing is also set to prevent dropout of raster lines. The amount of transient feed depends upon the parameters, such as the amounts of sheet feeding, in the standard printing operation and the intermediate processing.

As described above, the intermediate processing carries out the interlace printing with the apparently reduced number of working nozzles. This recording process extends the area that carries out recording of the image while ensuring the sufficient accuracy of sheet feeding. This point is described in detail by comparing the state of FIG. 11 with the state of FIG. 22.

Figure 22:
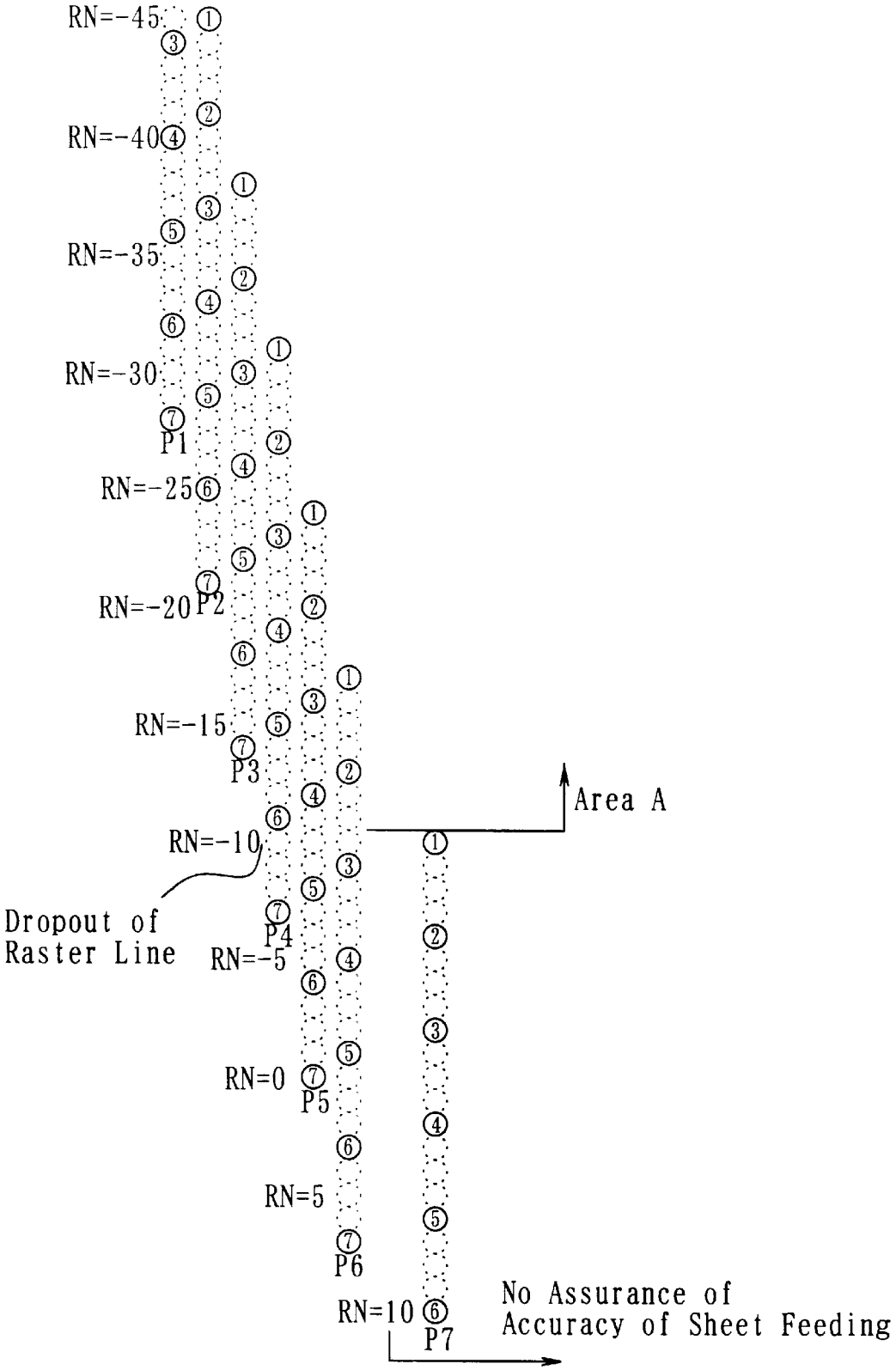
Fig. 22 Prior Art
FIG. 22 shows the state of dot creation by the interlace method of the prior art technique.

As described previously, FIG. 22 shows the state of recording the image by the interlace method with the fixed amount of sheet feeding corresponding to 7 raster lines. In the drawings of FIGS. 11 and 22, the positions of the raster lines in the sub-scanning direction are fixed. For example, the position of the nozzle #7 corresponds to the raster line RN=−7 in the pass P4 of the main scan. The nozzle pitch and the number of nozzles are also identical in both the examples of FIGS. 11 and 22. In the example of FIG. 22, the area up to the pass P6 of the main scan is the area with the sufficient accuracy of sheet feeding. There is dropout of a raster line RN=−10, so that the image is completed only in the area above the raster line RN=−11 (that is, the area of RN≦−11). In the example of FIG. 11, on the other hand, the intermediate processing enables the image to be completed in the area up to the raster line RN=0 (that is, the area of RN≦0).

The intermediate processing with the reduced number of working nozzles enables extension of the area where the image is recorded with the sufficient accuracy of sheet feeding. The reduction in number of working nozzles lowers the efficiency of dot creation and decreases the printing speed. The reduction in number of working nozzles may further cause the adjoining raster lines to be formed by the same nozzle. The structure of this embodiment sets the intermediate processing with the above amounts of sheet feeding by comprehensively taking into account these facts. The amount of sheet feeding in the intermediate processing may be varied according to these facts. In any case, however, the amount of sheet feeding in the intermediate processing should be smaller than the amount of sheet feeding in the standard printing operation. The greater amount of sheet feeding in the intermediate processing than in the standard processing operation does not enable extension of the area that records the image while ensuring the sufficient accuracy of sheet feeding.

After the dot recording operation by the intermediate processing, the CPU 41 carries out a positioning feed at step S400. The positioning feed is a sub-scan to the position of the pass P9 of the main scan in FIG. 11 and feeds the printing paper P by the amount corresponding to 7 raster lines in this embodiment. The amount of positioning feed is set according to the amount of sheet feeding in the subsequent extension printing operation as discussed below.

In this embodiment, the intermediate processing completes the image in the area above the raster line RN=0 (that is, the area of RN≦0). In the subsequent extension printing operation, the image should be recorded in the area below the raster line RN=1 (that is, the area of RN≧1). As clearly understood from FIG. 11, at the time when the intermediate processing is concluded, the nozzles #6 and #7 are already present in this area. Since the sub-scan is carried out only in one direction, the nozzles #6 and #7 can not be used in the extension printing operation. Namely the extension printing operation carries out recording by the interlace method only with five nozzles, the nozzles #1 through #5. In the description hereinafter, the nozzle #5 may be referred to as the end nozzle in this sense. If the extension printing operation is carried out with four nozzles up to the nozzle #4, the end nozzle is the nozzle #4.

In the state where the intermediate processing is concluded (that is, the pass P8 of the main scan of FIG. 11), the end nozzle #5 is located at the position (that is, on the raster line RN=−2 in FIG. 11) above the area where the image is completed. In order to record the image in the part below and adjoining to the raster line RN=1, it is required to carry out the interlace recording from the state where the position of the nozzle #5 coincides with the position of the raster line RN=0.

The sub-scan is required by the amount of sheet feeding set for the interlace printing, on the other hand, in order to carry out the extension printing operation. The amount of sheet feeding in the extension printing operation is specified by the same procedure as that for setting the amount of sheet feeding by the interlace method in the standard printing operation. The amount of sheet feeding specified in the extension printing operation corresponds to 5 raster lines. The amount of sheet feeding in the extension printing operation is smaller than that in the standard printing operation, since the number of working nozzles is reduced in the extension printing operation.

The amount of positioning feed at step S400 is thus set equal to 7 raster lines as the sum of the 2 raster lines, which is required for making the position of the end nozzle coincident with the position of the raster line RN=0, and the 5 raster lines, which is the amount of sheet feeding in the extension printing operation.

After the positioning feed, the CPU 41 sets the working nozzles at step S500 and carries out the data masking operation for the non-working nozzles at step S600. This embodiment sets the five nozzles, the nozzles #1 through #5, are set as the working nozzles as described above. The data masking operation prevents the dot creation data from being transferred to the transfer buffer 47 (see FIG. 7) and thereby interferes with creation of dots. In the table of FIG. 12, the symbol n/a is allocated to the nozzles #6 and #7 in the extension printing operation.

The CPU 41 subsequently carries out the extension printing operation at step S700. The basic flow of dot creation by the extending printing operation is similar to that of the standard printing routine shown in the flowchart of FIG. 9 and is thus not specifically illustrated. Different from the standard printing operation and the intermediate processing, the extension printing operation creates dots by the interlace method with the amount of sheet feeding corresponding to 5 raster lines. Namely the extension printing operation creates the dots at the positions in the passes P10 through P13 of the main scan shown in FIG. 11. Since the image has already been recorded in the area above the raster line RN=0 (that is, the area of RN≦0), no dots are created by the nozzles that are present in this area. For example, the nozzle #1 forms raster lines only in and after the pass P12 of the main scan in the course of extension printing.

As described above, the example of FIG. 11 shows the state of dot creation in the case where the nozzle pitch and the number of nozzles are reduced. The printer 22 of this embodiment actually has 48 nozzles arranged at the nozzle pitch corresponding to 6 raster lines. The tables of FIGS. 13 and 14 show the actual state of dot creation in the same format as that of FIG. 12. FIG. 13 shows the raster lines formed by the nozzles #1 through #24 in each pass of the main scan, whereas FIG. 14 shows the raster lines formed by the nozzles #25 through #48 in each pass of the main scan. As clearly shown in these tables, the procedure of the embodiment actually carries out the sheet feeding of 47 raster lines in the standard printing operation (step S200 in the flowchart of FIG. 8), a transient feed of 15 raster lines and the sheet feeding of 5 raster lines in the intermediate processing (step S300), a positioning feed of 47 raster lines (step S400), and the sheet feeding of 43 raster lines in the extension printing operation (step S700).

In the printer 22 of the embodiment, the interlace method is applied for the area of standard printing to give an image of high picture quality. The intermediate processing extends the area that records the image while ensuring the sufficient accuracy of sheet feeding. The image recording by the interlace method in the extended area ensures the high picture quality of the resulting printed image. The extension printing operation further extends the printable area in which the image can be recorded.

(3) Dot Creation Control in Second Embodiment

The following describes the procedure of dot creation control in a second embodiment according to the present invention. The printer of the second embodiment has the same hardware structure as that of the first embodiment. The main flow of dot creation control is also similar to that of the first embodiment shown in the flowcharts of FIGS. 8 and 9. The difference between the second embodiment and the first embodiment is the amount of sheet feeding.

Figure 15:
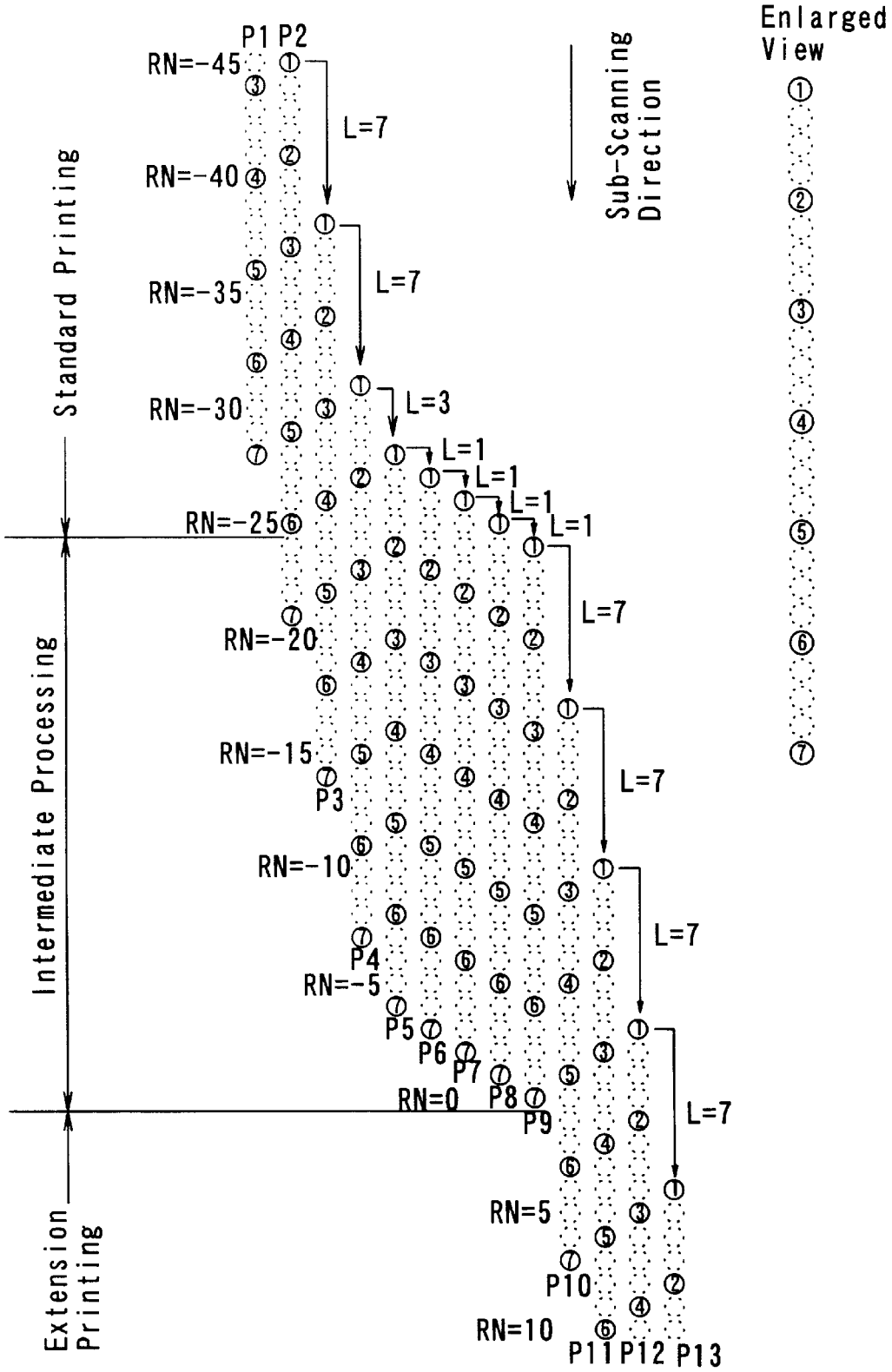
FIG. 15 shows the state of dot creation in a second embodiment according to the present invention.

FIG. 15 shows the state of dot creation in the second embodiment, and FIG. 16 is a table showing the raster lines formed by the respective nozzles in each pass of the main scan. As clearly understood from these drawings, the standard printing operation in the second embodiment forms raster lines while carrying out the sheet feeding of 7 raster lines.

In the subsequent intermediate processing, the procedure of the second embodiment records the image while carrying out the fine sheet feeding of one raster line, which follows a transient feed of 3 raster lines. The data masking operation that prevents creation of dots is carried out for the raster lines that have already been recorded. The amount of fine sheet feeding is given as the number of raster lines corresponding to the nozzle pitch. The nozzle #7 is necessarily set as the end nozzle in the case of the intermediate processing by the fine sheet feeding. This procedure enables the image to be completed in the area up to the raster line formed by the nozzle #7, which is located on the limit that ensures the sufficient accuracy of sheet feeding. The raster line RN=0 shown in FIG. 15 represents the position of the nozzle #7 in this state. The distance between the position of the raster line RN=0 and the lower end of the printing paper P is set substantially equal to the distance 'a' shown in FIG. 4.

In the arrangement of the second embodiment, since the nozzle #7 is the end nozzle, the extension printing operation after the intermediate processing can be carried out according to the interlace method by the same amount of sheet feeding as that for the standard printing operation. Namely the extension printing operation forms raster lines while carrying out the sheet feeding of 7 raster lines. The lower end of the area in which the image is recorded in the course of the intermediate processing coincides with the position of the end nozzle, so that the positioning feed (step S400 in the flowchart of FIG. 8) is not required in the second embodiment.

The printer of the second embodiment extends the area that records the image while ensuring the sufficient accuracy of sheet feeding to the mechanically allowable maximum range of the printer. The intermediate processing does not adopt the interlace method for dot recording, and there is accordingly a possibility of forming the adjoining raster lines with an identical nozzle. As shown in FIG. 15, the fine sheet feeding is applied only for several raster lines corresponding to the nozzle pitch. Non-adoption of the interlace method for dot recording thus does not significantly lower the picture quality.

In the structure of the second embodiment, the nozzle on the lower-most end of the head is necessarily set as the end nozzle. The extension printing operation can accordingly adopt the interlace method by the same amount of sheet feeding as that for the standard printing operation. This arrangement advantageously keeps the efficiency of dot creation. FIGS. 15 and 16 show the state of dot creation with the head having seven nozzles arranged at the nozzle pitch of 4 raster lines. The principle of the second embodiment is, however, applicable to any head having an arbitrary number of nozzles arranged at an arbitrary nozzle pitch.

(4) Dot Creation Control in Third Embodiment

The following describes the procedure of dot creation control in a third embodiment according to the present invention. The printer of the third embodiment has the same hardware structure as that of the first embodiment. The main flow of dot creation control is also similar to that of the first embodiment shown in the flowcharts of FIGS. 8 and 9. The difference between the third embodiment and the first embodiment is the amount of sheet feeding.

Figure 17:
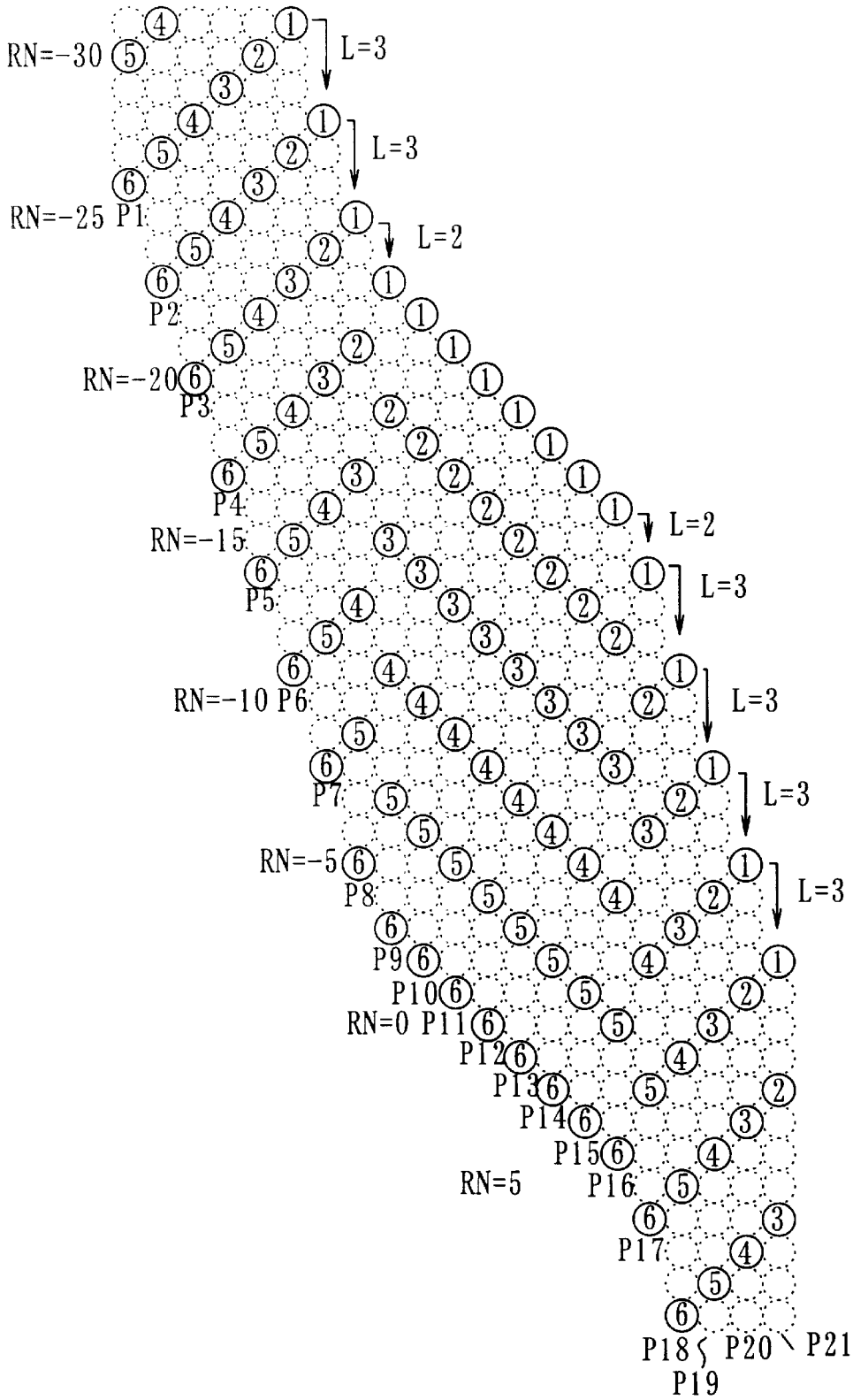
FIG. 17 shows the state of dot creation in a third embodiment according to the present invention.

FIG. 17 shows the state of dot creation in the third embodiment, and FIG. 18 is a table showing the raster lines formed by the respective nozzles in each pass of the main scan. For convenience of explanation, the third embodiment regards the head with six nozzles arranged at the nozzle pitch of 4 raster lines. The principle of the third embodiment is, however, applicable to any head having an arbitrary number of nozzles arranged at an arbitrary nozzle pitch.

In the structure of the third embodiment, the standard printing operation carries out the sheet feeding of 3 raster lines (the passes P1 through P8 of the main scan in FIG. 17). As clearly understood from FIG. 17, this embodiment forms each raster line by two passes of the main scan with different nozzles. Namely the number of repeated scans is equal to 2. The dot recording method in the case of the number of repeated scans equal to or greater than 2 is referred to as the 'overlap method'. For example, when the number of repeated scans is equal to 2, the overlap recording method first creates dots of odd numbers intermittently in the course of the first pass of the main scan and then creates dots of even numbers intermittently in the course of the second pass of the main scan, so as to complete an array of dots aligned in the main scanning direction and form each raster line. Different nozzles are used for the two passes of the main scan. The overlap recording method forms each rater line with different nozzles, thereby dispersing positional deviation of dots due to the mechanical errors of the nozzles in the manufacturing process and improving the picture quality.

As shown in FIG. 17, the standard printing operation in the third embodiment carries out the sheet feeding of 3 raster lines and implements the overlap method with the number of repeated scans equal to 2 (the passes P1 through P8 of the main scan). Like the first embodiment, the structure of the third embodiment selects the optimum amount of sheet feeding that enables the nozzles to be used most effectively among alternative amounts of sheet feeding that enable an image to be recorded with no dropout of raster lines by the interlace method. The amount of sheet feeding is necessarily set to allow each raster line to be formed with different nozzles.

After the standard printing operation, the intermediate processing carries out a transient feed of 2 raster lines (the pass P9 of the main scan) and then the fine sheet feeding of one raster line (the passes P10 through P16 of the main scan) to record the image. Each raster line is also formed by two passes of the main scan in the course of the intermediate processing. After the intermediate processing, the procedure carries out a transient feed of 2 raster lines and the extension printing operation by the sheet feeding of 3 raster lines, which is identical with the sheet feeding in the standard printing operation.

The structure of the third embodiment creates each array of dots by two passes of the main scan. Each of the passes P13 through P16 of the main scan in the intermediate processing cooperates with one pass, for example, P17 or P18, of the main scan in the extension printing operation to form each raster line. Irrespective of adoption of the fine sheet feeding of one raster line for the intermediate processing, the area that enables the image recording with the sufficient accuracy of sheet feeding is limited to the range up to the raster line RN=0 corresponding to the position of the nozzle #6 in the pass P12 of the main scan. One possible modification forms each raster line by one pass of the main scan with respect to the passes P13 through P16 of the main scan. This arrangement extends the area that enables the image recording with the sufficient accuracy of sheet feeding to the range up to the raster line RN=4. A variety of sheet feeding amounts other than the fine sheet feeding of one raster line shown in FIG. 17 are naturally applicable to the intermediate processing.

The printer of the third embodiment adopts the intermediate processing and the extension printing operation to extend the printable area where the image can be recorded, while implementing the dot recording by the overlap method, thereby giving the image of higher picture quality.

(5) Other Applications

Figure 19:
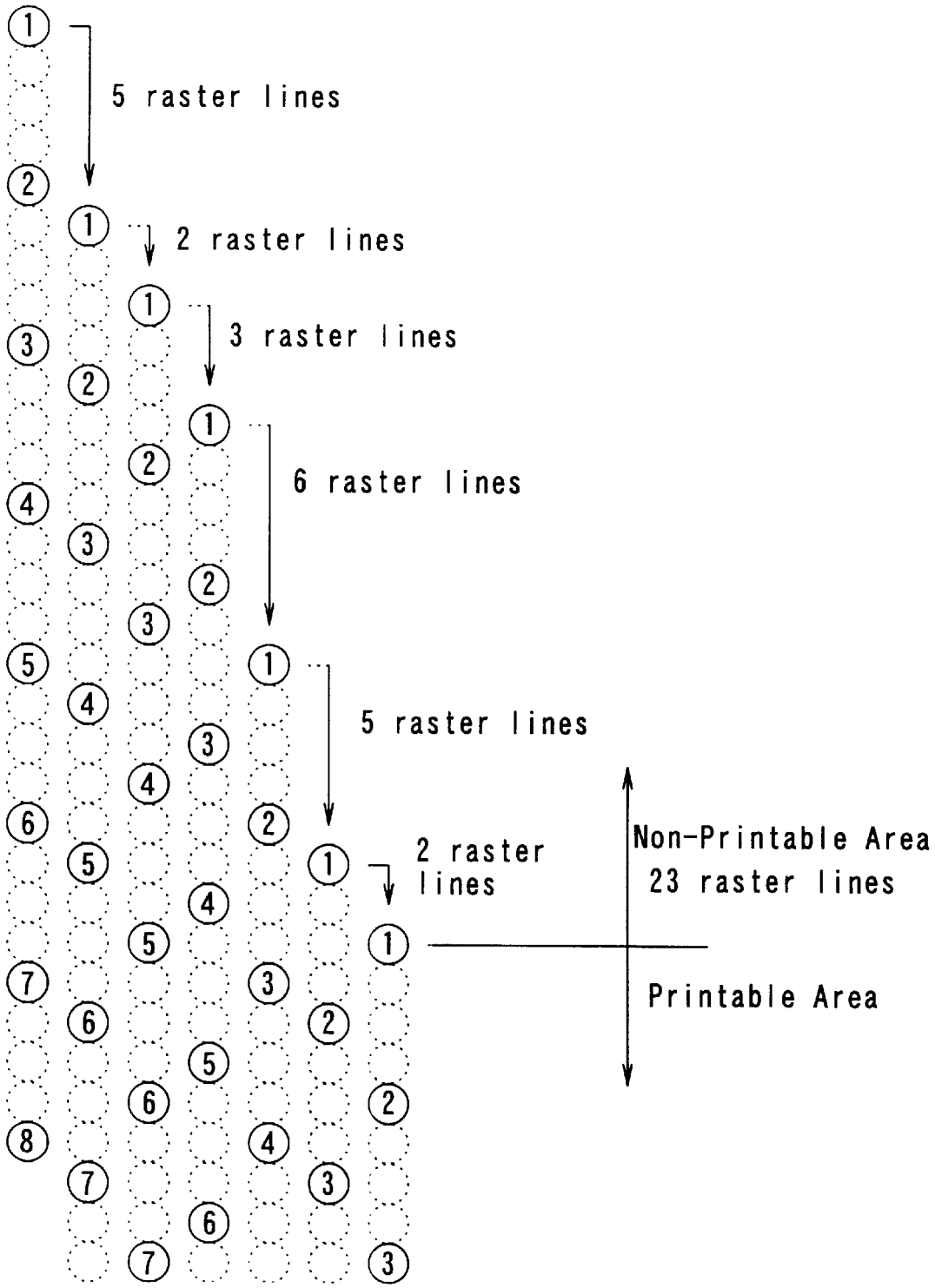
FIG. 19 shows the state of dot creation in the case of irregular feeding.

In the printers of the first through the third embodiments discussed above, the standard printing operation carries out the sheet feeding of a fixed amount. One possible modification adopts the irregular feeding technique using a combination of different feeding amounts as one cycle. FIG. 19 shows an example of the irregular feeding, in which dots are recorded with the head having eight nozzles arranged at the nozzle pitch of 4 raster lines. Different from the above embodiments, this modified structure carries out the sheet feeding in one cycle consisting of 5 raster lines, 2 raster lines, 3 raster lines, and 6 raster lines and records the image with the number of repeated scans equal to 2. In the printers of the respective embodiments, a variety of sheet feeding amounts may be set for the standard printing operation, the intermediate processing, and the extension printing operation.

In the above embodiments, the standard printing operation carries out printing in a fixed cycle of feeding amounts from the upper end of the image. In the case where the interlace method is applied to record the image, there is a non-printable area, in which the image can not be recorded, in an upper-end portion as clearly understood from the example of FIG. 19. One modification carries out upper-end processing in the upper-end portion. The upper-end processing implements the sub-scan by a predetermined feeding amount that is different from the feeding amounts in the standard printing operation.

Figure 20:
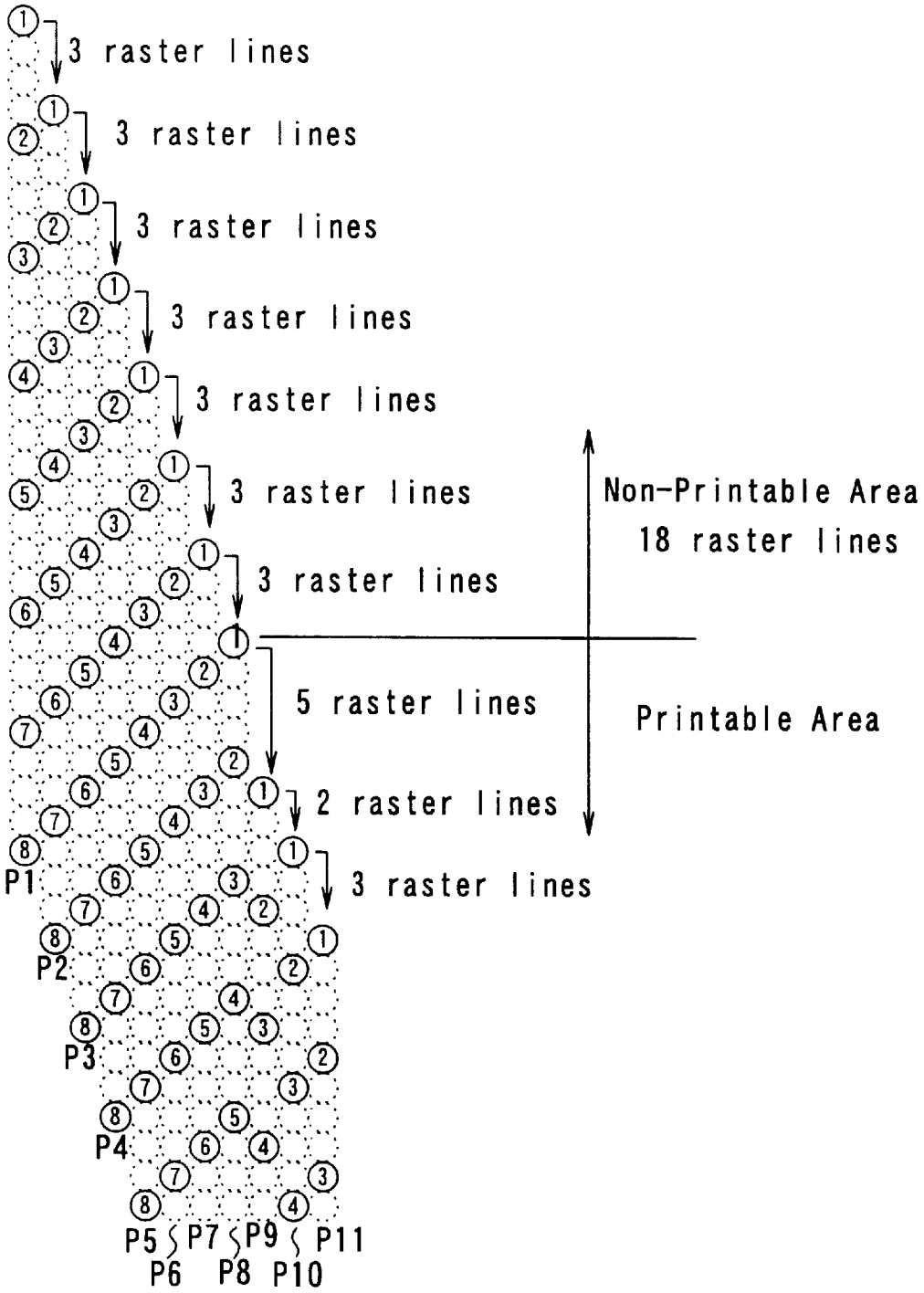
FIG. 20 shows an example of upper-end processing.
Figure 21:
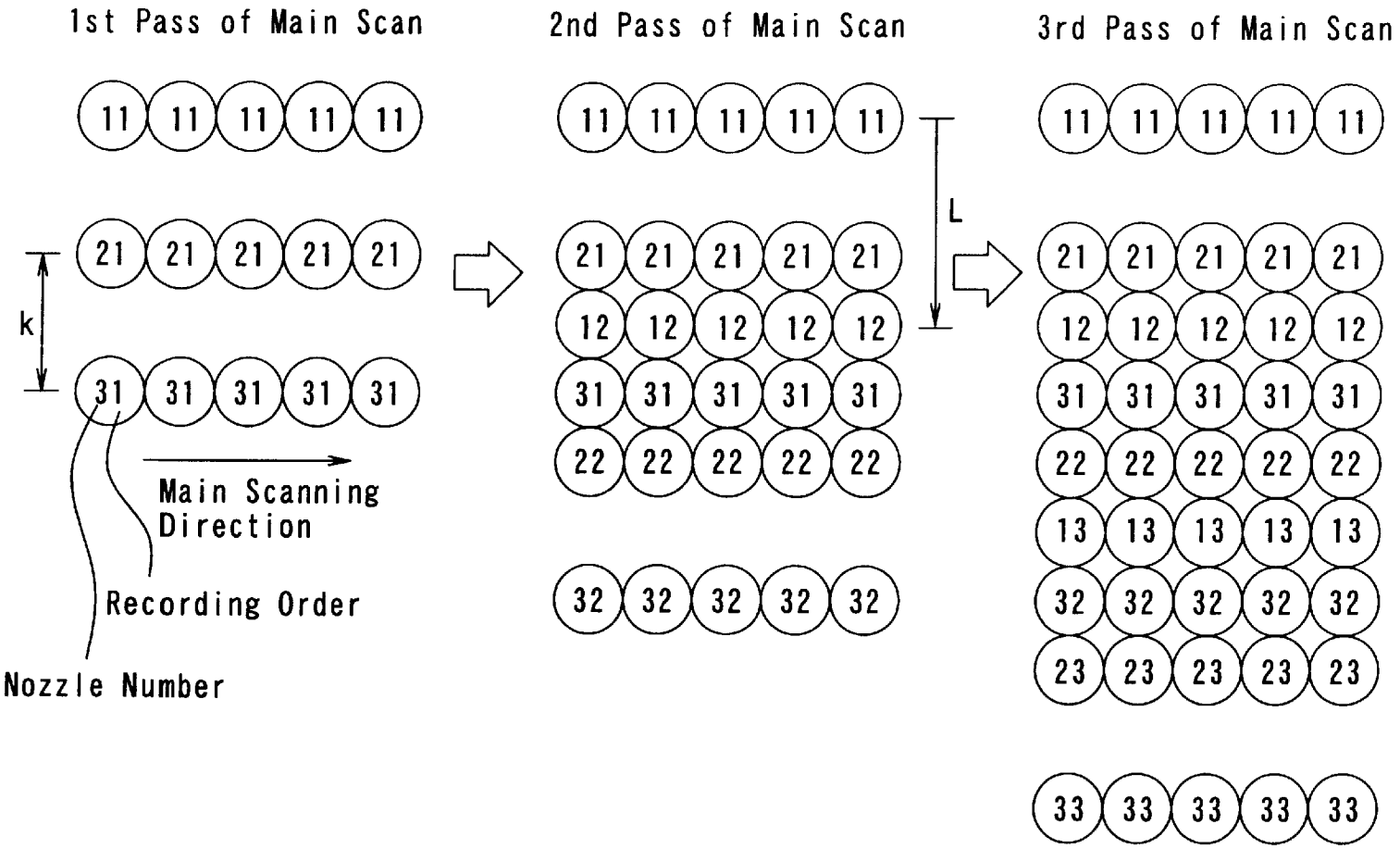
Fig. 21 Prior Art
FIG. 21 shows a process of dot recording by the interlace method.

FIG. 20 shows an example of the upper-end processing. This upper-end processing is carried out, prior to the irregular feeding shown in FIG. 19. Referring to FIG. 20, seven sub-scans are performed by a fixed amount of 3 raster lines, prior to the irregular feeding. There is a non-printable area corresponding to 23 raster lines when no upper-end processing is carried out as shown in the example of FIG. 19. The upper-end processing reduces this non-printable area to the range of 18 raster lines. Other techniques of the upper-end processing may be applied for the printers of the embodiments.

In the above embodiments, the accuracy of sheet feeding is ensured by the rollers in the feeding section as described with the drawing of FIG. 4. The principle of the present invention is also applicable to the arrangement in which the accuracy of sheet feeding is ensured by the rollers in the delivering section. In the latter case, opposite to the embodiments discussed above, the procedure carries out the extension printing operation, the intermediate processing, and the standard printing operation in this sequence to record the image from the upper end of the printable area. The procedure records the image by the interlace method with a predetermined feeding amount in the extension printing operation, carries out the sheet feeding corresponding to the upper-end processing in the intermediate processing, and shifts to the standard printing operation. In this case, the technique of fine sheet feeding is also applicable for the intermediate processing.

In all the above embodiments, the CPU 41 incorporated in the printer 22 executes the dot creation control shown in the flowcharts of FIGS. 8 and 9. This structure enables the printer driver 96 to output the image data of a fixed format, irrespective of the method of dot creation and thereby reduces the processing load of the computer 90. In accordance with another possible structure, the printer driver 96 may set the data for dot creation in the dot creation control routine discussed above. In this case, the dot data to be created in the first pass of the main scan, the sheet feeding amount of the sub-scan, the dot data to be created in the second pass of the main scan, . . . , are successively transferred to the printer 22. The format of the image data output from the printer driver 96 should be varied according to the method of dot creation. This structure, however, facilitates a change to a later version and enables a new dot recording method to be actualized without changing the PROM 42 and the other related elements of the printer 22.

The present invention is not restricted to the above embodiments or their modifications, but there may be many other modifications, changes, and alterations without departing from the scope or spirit of the main characteristics of the present invention. The above embodiments regards the printer that forms raster lines while the head carries out the main scan. The principle of the present invention is, however, applicable to other printers, for example, a line printer that forms raster lines without the main scan. The principle of the present invention is applicable to color printers with various numbers of color inks as well as to monochromatic printers. The present invention is also applicable to the printing unit included in facsimiles and copying machines.

It should be clearly understood that the above embodiments are only illustrative and not restrictive in any sense. The scope and spirit of the present invention are limited only by the terms of the appended claims.

What is claimed is:

1. A printer that forms a plurality of raster lines with a head, each of the raster lines comprising an array of dots aligned in a raster-forming direction, which is one direction of a printing medium, and carries out a sub-scan that moves said head in a sub-scanning direction relative to said printing medium, which is another direction crossing the raster-forming direction, thereby printing an image corresponding to input image data on said printing medium, said printer comprising:

said head having n nozzles configured to create dots of an identical color and arranged in the sub-scanning direction at a fixed interval, where n denotes an integer of not less than 2;

a raster-forming unit that drives said head to form the plurality of raster lines;

a first sub-scan unit that carries out the sub-scan by a first feeding amount with a first accuracy in a first area on said medium;

a second sub-scan unit that carries out the sub-scan by a second feeding amount with a second accuracy, which is lower than the first accuracy, at a predetermined position in a second area on said medium;

a first control unit that controls said first sub-scan unit and said raster-forming unit in the first area where said first sub-scan unit carries out the sub-scan and records a portion of the image; and a second control unit that controls said second sub-scan unit and said raster-forming unit in the second area where said second sub-scan unit carries out the sub-scan and completes recording of the image, wherein said first control unit causes said first sub-scan unit to carry out the sub-scan by the first feeding amount that allows adjoining raster lines to be formed with different nozzles in a predetermined section of the first area that does not adjoin to the second area and to carry out the sub-scan by a third feeding amount, which is smaller than the first feeding amount and which differs from the second feeding amount in a middle area on said medium that adjoins both to the predetermined section of the first area and to the second area.

2. A printer in accordance with claim 1, wherein the second area is apart from the first area in the sub-scanning direction, the fixed interval of said nozzles is p raster lines, where p denotes an integer of not less than 2, and the middle area is within m+1 raster lines, where m denotes an integer of $p\times(n-1)$.

3. A printer in accordance with claim 2, wherein the sub-scan in the middle area causes adjoining raster lines to be formed with different nozzles.

4. A printer in accordance with claim 2, wherein the sub-scan in the middle area has a feeding amount of one raster line.

5. A printer in accordance with claim 1, wherein each of said first sub-scan unit and said second sub-scan unit comprises rollers for feeding said printing medium, and frictional force applied by said rollers to said printing medium is higher in said first sub-scan unit than in said second sub-scan unit.

6. A printer in accordance with claim 1, wherein said head spouts ink and creates dots, and said first sub-scan unit is disposed before said head while said second sub-scan unit is disposed after said head.

7. A method of forming a plurality of raster lines with a head, each of the raster lines comprising an array of dots aligned in one direction of a printing medium or in a raster-forming direction, and carrying out a sub-scan that moves said head in another direction crossing the raster-forming direction or in a sub-scanning direction relative to said printing medium, thereby printing an image corresponding to input image data on said printing medium, said head having n nozzles configured to create dots of an identical color and arranged in the sub-scanning direction at a fixed interval, where n denotes an integer of not less than 2;

said method comprising the steps of:

(a) carrying out the sub-scan by a first feeding amount with a first accuracy to record a portion the image in a first area on said printing medium; and (b) carrying out the sub-scan by a second feeding amount with a second accuracy, which is lower than the first accuracy, to record the image in a second area on said printing medium to complete recording of the image, wherein said step (a) carries out the sub-scan by the first feeding amount that allows adjoining raster lines to be formed with different nozzles in a predetermined section of the first area that does not adjoin to the third area, and carries out the sub-scan by a third feeding amount, which is smaller than the first feeding amount and which differs from the second feeding amount, in a middle area on said printing medium that adjoins to both the predetermined section of the first area and the second area.

8. A recording medium, in which a program for causing a printer to form raster lines and carry out a sub-scan in order to print an image corresponding to image data on a printing medium is recorded in a computer readable manner, said program causing a computer to carry out the functions of:

dividing a printable area, in which the image can be recorded, into a first area where the sub-scan is carried out by a first feeding amount with a first accuracy, to record a portion of the image in the first area, and a second area where the sub-scan is carried out by a second feeding amount with a second accuracy, which is lower than the first accuracy, to complete recording of the image in the second area;

outputting a first control signal to carry out the sub-scan by the first feeding amount that allows adjoining raster lines to be formed with different nozzles in a predetermined section of the first area that does not adjoin to the second area; and outputting a second control signal to carry out the sub-scan by a third feeding amount, which is smaller than the first feeding amount and which differs from the second feeding amount, in a middle area of the printable area that adjoins both to the predetermined section of the first area and to the second area.

* * * * *